US005281100A

United States Patent [19]

Diederich

[11] Patent Number: 5,281,100

[45] Date of Patent: Jan. 25, 1994

[54] WELL PUMP CONTROL SYSTEM

[75] Inventor: Richard E. Diederich, South Pasadena, Calif.

[73] Assignee: A.M.C. Technology, Inc., Haverhill, Mass.

[21] Appl. No.: 867,754

[22] Filed: Apr. 13, 1992

[51] Int. Cl.[5] ..... F04B 49/00

[52] U.S. Cl. ..... 417/18; 417/22; 417/46; 417/399; 60/372

[58] Field of Search ..... 417/18, 20, 22, 43, 417/46, 399; 60/372

[56] References Cited

U.S. PATENT DOCUMENTS

| | | | |
|---|---|---|---|
| 3,971,213 | 7/1976 | Kelly | 60/372 |
| 4,286,925 | 9/1981 | Standish | 417/18 |
| 4,406,122 | 9/1983 | McDuffie | 60/372 |
| 4,483,662 | 11/1984 | Stanton | 60/372 |
| 4,530,645 | 7/1985 | Whatley et al. | 417/399 |
| 4,990,058 | 2/1991 | Eslinger | 417/46 |

*Primary Examiner*—Richard A. Bertsch
*Assistant Examiner*—David W. Scheuermann
*Attorney, Agent, or Firm*—Christie, Parker & Hale

[57] ABSTRACT

A well pumping system includes a pivotally mounted walking beam and "horsehead" connected to a downhole pump by a pump rod in the conventional manner. A hydraulic lift piston and cylinder and a pneumatic balance piston and cylinder are connected to the walking beam. A process control computer controls input signals to a hydraulic control valve for controlling the hydraulic cylinder rate and direction of travel to provide corresponding control over the motion of the walking beam. The computer receives input information from a position sensor indicating the displacement of the beam in its range of travel. The computer program also is responsive to a timer for determining actual stroke rate and acceleration of the beam. The computer monitors and controls operation of the hydraulics and pneumatics as the pumping unit produces the lift necessary to extract fluid from the well. The computer controls acceleration and deceleration of the walking beam assembly in accordance with a desired acceleration-versus-time and deceleration-verus-time waveform. Closed loop control is used to cause actual beam displacement, displacement rate and acceleration to follow a desired displacement, rate, and acceleration profile. As a result, any sudden movement or directional change is eliminated, and the system reduces energy consumption and wear and tear on the pumping equipment.

23 Claims, 14 Drawing Sheets

240/480 3Ø INPUT POWER
108
110
120
PUMP MOTOR CONTACTOR
AIR COMPRESSOR CONTACTOR
POWER TRANS-FORMER
240/480 TO 110 VAC
122
SYSTEM ON/OFF SWITCH
TO PUMP MOTOR
112
DC POWER SUPPLY
VOLTAGE DISTRIBUTION BOARD
TO AIR COMPRESSOR MOTOR
SSR1
114
118
SSR2
116
AIR COMPRESSOR PRESSURE SWITCH
VOLTAGE TO COMPUTER
RELAY CONTROL FROM COMPUTER

MC Ø A
MC Ø B
MC1
194
ARM POSITION > UP VEL. XOVER
YES
196
SET CYCLE = 3
CEND MC Ø
198
ARM POSITION > UP VEL. XOVER
YES
202
DAC VALUE > UP MAX
YES
200
SET CYCLE = 2
204
ADD UP VEL. INCREMENT TO DAC VALUE
DAC OUT MC5
CEND MC Ø
UP VELOCITY (CONTINUED)
206
CYCLE = 2
YES
208
ARM POSITION > UP NEG. VEL. XOVER
YES
210
SET CYCLE = 3
CEND MC Ø
UP CONSTANT
MC 2 A

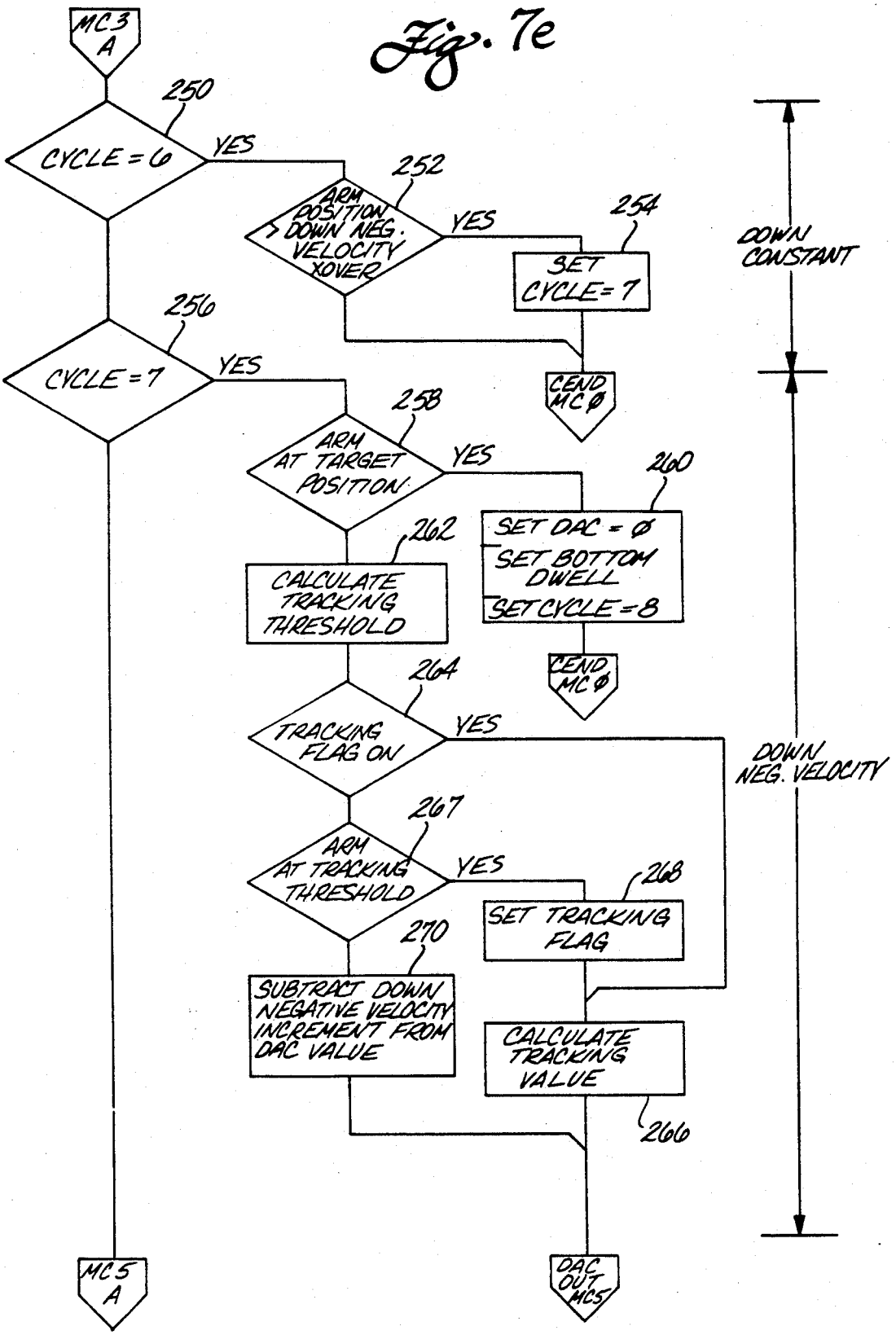
Fig. 7e
MC3 A
250
CYCLE = 6
YES
252
ARM POSITION > DOWN NEG. VELOCITY XOVER
YES
254
SET CYCLE = 7
CEND MCØ
256
CYCLE = 7
YES
258
ARM AT TARGET POSITION
YES
260
SET DAC = Ø
SET BOTTOM DWELL
SET CYCLE = 8
CEND MCØ
262
CALCULATE TRACKING THRESHOLD
264
TRACKING FLAG ON
YES
267
ARM AT TRACKING THRESHOLD
YES
268
SET TRACKING FLAG
270
SUBTRACT DOWN NEGATIVE VELOCITY INCREMENT FROM DAC VALUE
CALCULATE TRACKING VALUE
266
MC5 A
DAC OUT MC5
DOWN CONSTANT
DOWN NEG. VELOCITY

WELL PUMP CONTROL SYSTEM

FIELD OF THE INVENTION

This invention relates to well pumping systems, and more particularly to a control system using digital computer techniques for accurately controlling the dynamic motion of a rocker arm-driven well pump.

BACKGROUND OF THE INVENTION

A conventional well pumping system includes a large rocker arm for reciprocating a pump rod which extends downhole for connection to a piston of a pump mounted within the well. The rocker arm typically includes a pivotally mounted "walking beam" and "horsehead" mounted on a framework adjacent the well head. The walking beam pivots to reciprocate the pump rod vertically. The walking beam is commonly driven by a complex mechanical drive system. One such drive system can include a crank connected between the walking beam and a rotating arm mounted on a drive shaft driven through a gear box from a drive motor.

It often becomes necessary, or at least desirable, to make mechanical changes to the pump drive system dynamics during use. For instance, changing the stroke length or stroke rate (strokes per minute) of the pump often requires mechanical changes which are time consuming and costly. To change the stroke length, for example, requires changing the pivot pin location on the walking beam, together with other mechanical changes in the linkage between the walking beam and the downhole pump. These changes can require special equipment and additional personnel. It can require a crane to lift the walking beam while the beam's pivot is changed, for example. At least a half day's production time can be lost when changing the stroke length and stroke rate of the pump.

Prior well pumping systems also commonly experience field conditions that produce wear and tear on the equipment and reduce operating efficiency. Substantial loads are imposed on the pump rod of conventional pumping equipment. Large shock loads, especially, are placed on the pump rod as it reciprocates in a well which can be several thousand feet deep, or more. Downhole conditions in the well are often unpredictable and can cause sudden movements or directional changes in the pumping equipment.

Wear and tear on conventional well pumping equipment is especially severe when the pump undergoes a pumping-off condition, in which lift occurs above the fluid level in the well. This condition pulls a vacuum in the production tubing and creates severe impacts on the pumping equipment if the condition is not corrected. In prior well pumping systems, a pumping-off condition is sensed and the pump is stopped. Often, steam is injected downhole to change the viscosity and flow rate of the oil in order to correct the condition.

The present invention provides a system for automatically controlling the motion of a rocker arm-driven well pump. The control system senses the actual motion of the rocker arm throughout its pumping cycle and constantly adjusts its travel in accordance with a desired pumping motion. The control system provides a number of improvements over the conventional mechanically operated well pumping equipment. For instance, the stroke length and number of strokes per minute of the rocker arm can be easily adjusted Acceleration and deceleration of the walking beam can be controlled for each upstroke independently of each downstroke of the beam. These controls are equivalent to moving the pivot of the fulcrum of a conventional pump; but such control is produced without requiring complex mechanical changes to the pumping equipment. Precise control over pumping motion throughout the pumping cycle also reduces shock loading and wear and tear on the equipment. In addition, the control system can pre-sense a pumping-off condition and quickly adjust the stroke length to maintain production while avoiding impact loading on the equipment. Thus, wear and tear on the equipment are reduced, and valuable production time is not lost.

SUMMARY OF THE INVENTION

Briefly, one embodiment of this invention is a well pumping system for controlling the displacement of a pivotally supported rocker arm-type beam connected to a pump rod extending to a downhole pump. The pump rod reciprocates as the beam pivots cyclically. A drive system is connected to the beam for displacing the beam cyclically over a stroke length. A drive system controller receives an input control signal to operate the drive system to displace the beam in proportion to the magnitude of the input control signal. The actual position of the beam is sensed, and a position signal is produced representing the actual cyclical displacement of the beam during its operation of the pump rod. A beam motion control system responds to the beam position signal to control beam motion throughout its stroke length. The beam motion control system receives a control input representing a predetermined beam velocity-versus-time waveform. The motion control system constantly compares the control input and the beam position signal for constantly adjusting the input control signal to the drive system controller in accordance with any deviation, for causing the beam displacement to follow the predetermined velocity-versus-time waveform.

In one embodiment, a computer-controlled closed loop control system detects position feedback information and constantly produces control signals sent to the controller for controlling beam motion in accordance with the predetermined acceleration and deceleration waveform. The control system constantly monitors beam displacement and rate and makes appropriate adjustments in the control signal to the controller for causing the beam to follow the desired velocity waveform. If the control system detects that the beam is moving too fast, it can quickly decelerate the beam to smooth out its travel. If the beam moves too slowly, the controller can be instructed to speed up beam travel. The effect is that a desired time-dependent pumping motion can be produced which can smooth out beam motion and greatly reduce wear and tear on the pumping equipment.

One embodiment of the pumping system includes a hydraulic piston and cylinder for driving the beam and a hydraulic control valve for controlling hydraulic piston cycling in accordance with signals from the computer-operated control system. Inputs to the control system can include adjustments to the velocity-versus-time waveform. For instance, acceleration and deceleration during the upstroke of the beam can be controlled independently from the time-dependent acceleration and deceleration of the downstroke of the beam. As a result, the system, in effect, moves the equivalent pivot point of the walking beam throughout each pivot cycle, an effect not possible with the prior art mechanical drive systems for the rocker arm, in which the pivot point of the rocker arm and corresponding changes in its linkage are only accomplished at great expense.

In another embodiment of the invention, inputs to the control system can include beam stroke length, beam rate (strokes per minute), and volume flow information on the type of hydraulic cylinder used for driving the beam. This information can be changed at any time, depending upon current pumping conditions.

One sub-system of the invention comprises a load cell sensor for detecting undue strain on the beam, for pre-sensing a possible pumping-off condition. In this instance, the load cell output can instruct the computer to override normal operation of the beam and shorten the effective stroke length of the beam. As a result, production can continue until the pumping-off condition is alleviated, without the necessity of stopping pumping operations or making other mechanical or processing changes at the well site.

These and other aspects of the invention will be more fully understood by referring to the following detailed description and the accompanying drawings.

FIGS. *7a–7b* show a schematic flow diagram illustrating processing steps in the computer-operated controls of the control system.

Figure 8:
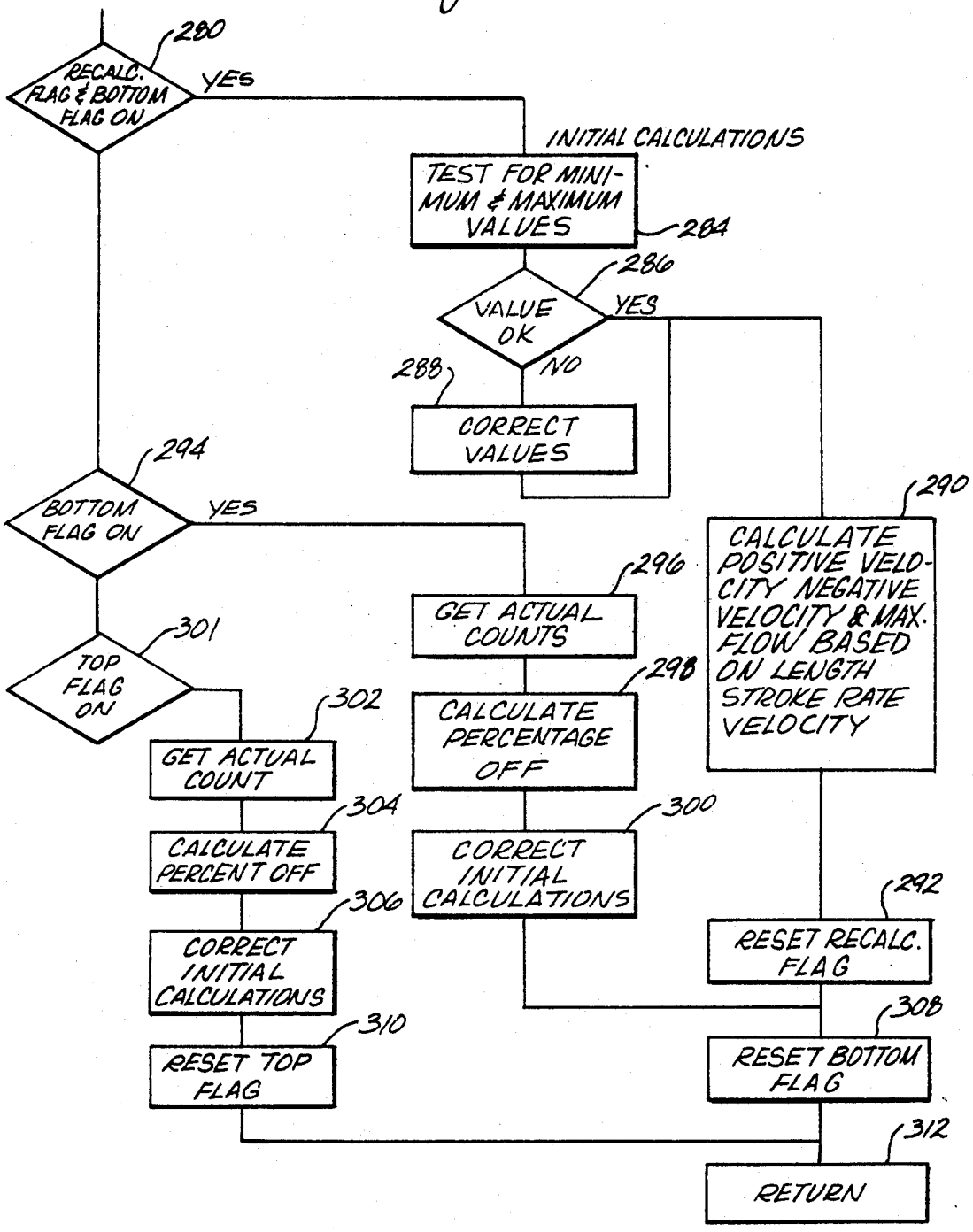

FIG. 8 is a schematic flow diagram illustrating processing steps in a recalculation sub-routine of the computer-operated control system.

Figure 9:
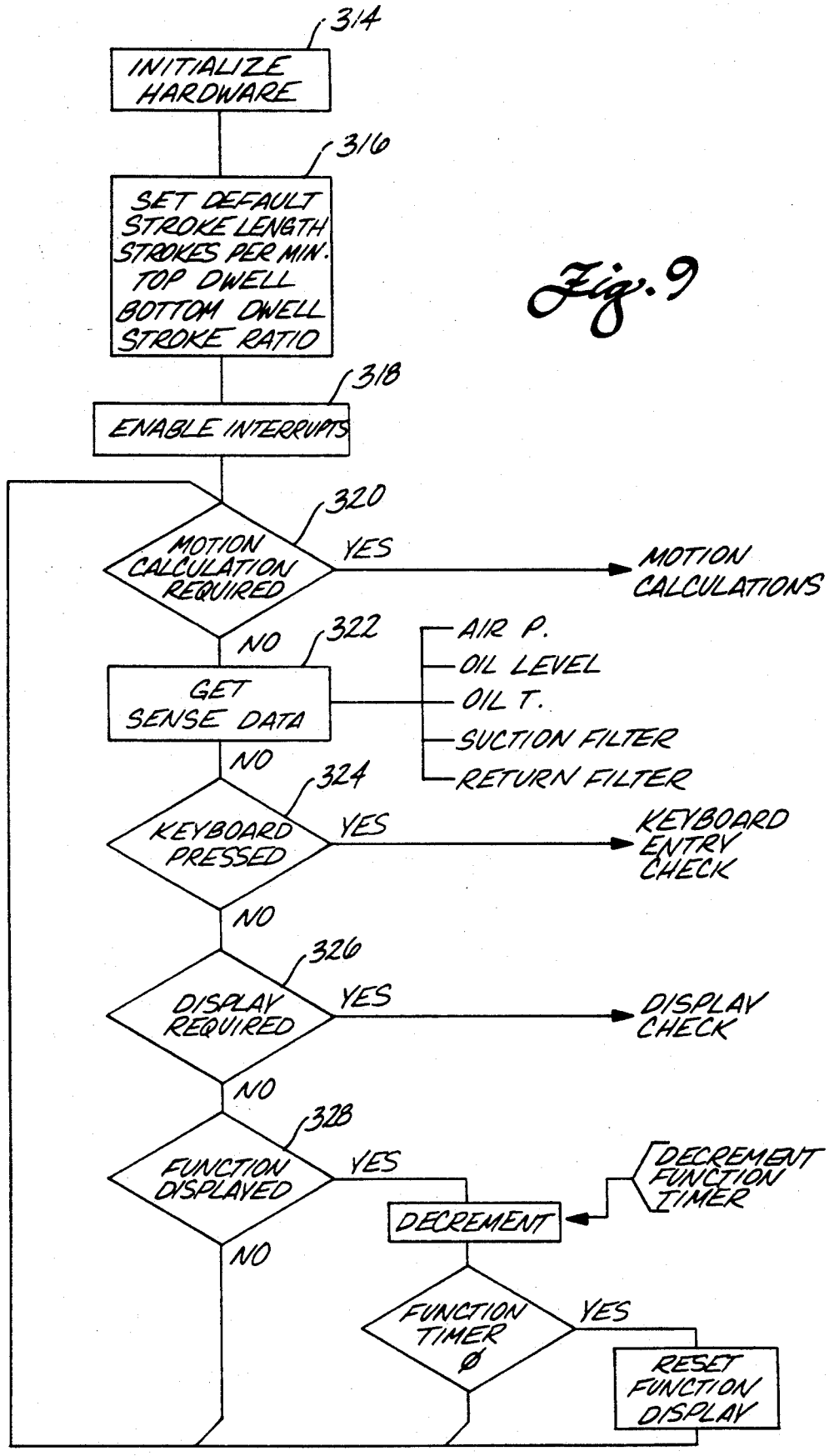

FIG. 9 is a schematic flow diagram illustrating processing steps in a main sensing loop of the control system.

DETAILED DESCRIPTION

Generally speaking, the well pumping system of this invention includes a hydraulic system for operating a well pump, a pneumatic system for counterbalancing the weight of the pump, and a control system using closed-loop feedback control techniques for controlling motion of the pump throughout the pumping cycle. The pump is a rocker arm-type pumping unit for reciprocating a pump rod extending downhole in a well. The control system includes a microprocessor for receiving data input signals from sensors coupled to the pump. The input data provide information on the actual movement of the rocker arm and other information used by the computer to control motion of the pump.

Figure 1:
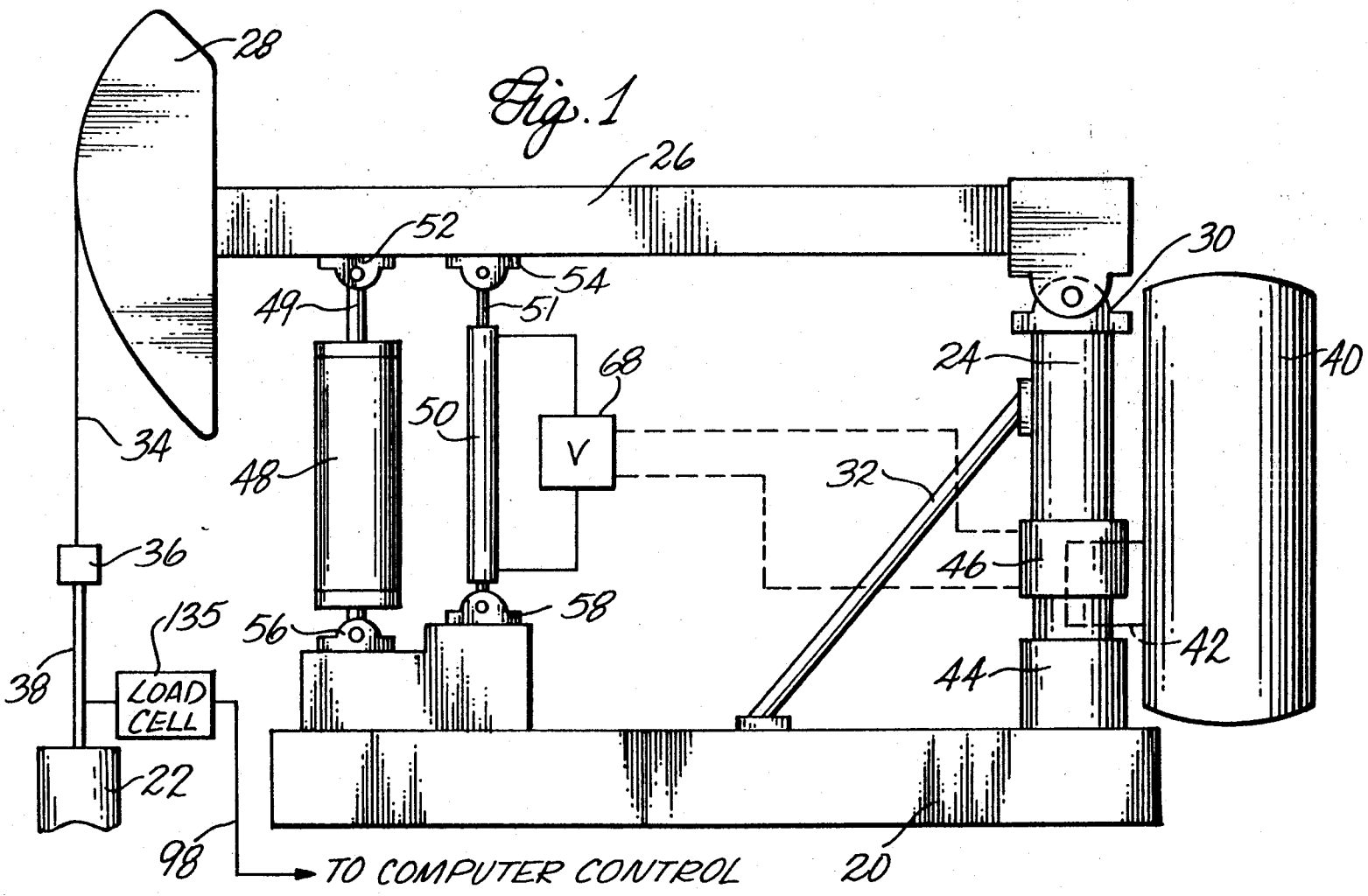
FIG. 1 is a schematic side elevation view illustrating components of a well pumping system according to principles of this invention.

FIG. 1 schematically illustrates mechanical components of one embodiment of the invention, in which a well pumping system includes a base frame 20 for mounting pumping equipment adjacent a well head 22. A Samson post 24 supports a generally horizontally extending elongated walking beam 26 spaced above the base frame. A horsehead 28 is mounted at the end of the walking beam above the well head. The opposite end of the walking beam is supported by a saddle bearing 30 atop the Samson post. The horsehead oscillates in a vertical plane about the axis of the saddle bearing. Angular support arms 32 provide rigid support for the Samson post. The horsehead supports a bridle strap 34 and polish rod hanger 36 connected to a polish rod 38 extending through the well head. The walking beam pivots through an angle to reciprocate the horsehead vertically in the conventional manner. This causes vertical reciprocation of the polish rod and a pump rod (not shown) to vertically reciprocate the piston of a downhole well pump (not shown) so that well fluid, such as crude oil, can be pumped upwardly from the well.

The stroke length of the walking beam is a measurement of the distance through which the beam travels during its angular motion The stroke length can be defined as the length of the arc through which the horsehead end of the beam travels. The stroke length is primarily determined by the type of downhole pump being used. As described, the stroke length of the pump can be easily adjusted according to principles of this invention.

The base frame 20 provides support for other system components which include a large low pressure air reservoir 40, an air compressor 42, an electrical control box 44, and a computer-operated pump motion control system 46.

An air cylinder 48 is mounted between the base frame 20 and an end portion of the walking beam adjacent the horsehead. Air pressure cycled through the air cylinder reciprocates an elongated piston rod 49 extending from the top of the air cylinder for connection to the walking beam. The air cylinder is pneumatically coupled to the large low pressure air reservoir 40. The pneumatic system balances ±6% the weight of the walking beam and the downhole equipment and load.

An upright hydraulic cylinder 50 is mounted on the base frame adjacent the air cylinder 48. The hydraulic cylinder is mechanically connected between the base frame and the walking beam. A piston rod 51 extends from the top of the hydraulic cylinder for connection to the walking beam. The upper ends of the piston rods in the air cylinder and hydraulic cylinder are pivotally connected to bearings 52 and 54 mounted to the underside of the walking beam. The bearings are spaced from the pivot axis at the saddle bearing 30. Hydraulic fluid cycled through the hydraulic cylinder reciprocates the piston rod 51 for cyclically pivoting the walking beam through an arc. Bearings 56 and 58 pivotally mount lower ends of the air cylinder and hydraulic cylinder to the base frame. The bearings act as pivot blocks to provide rotational motion at the opposite ends of the cylinders in response to the reciprocating motion of the walking beam.

The electrical control box 44 is connected to the pumping unit to provide control to start and stop motors on the air system and the hydraulic system. The computer-operated control system 46 sends control signals to the electrical control box for starting and stopping the motors.

The pump motion control system 46 produces control signals to the electrical control box 44 for starting and stopping the air compressor 42 and for adjustments in the air balance produced by the air cylinder 48 so as to maintain balance on the pumping unit. The air pressure system counterbalances the weight of the piston rod string on the beam to reduce the power required for the hydraulic system to drive the pump. As described in greater detail below, the computer controls a hydraulic valve 68 (FIG. 2) which, in turn, controls the rate and direction of pressurized hydraulic fluid flow to reciprocate the walking beam. The computer controls can vary the stroke length, stroke rate, and acceleration and deceleration of the walking beam. It can also produce dwell times in the motion of the walking beam at the top and bottom of each stroke. The computer also receives information from sensors for use in making operational adjustments to the pumping unit to compensate for a variety of external conditions. The computer can have a communication capability so that adjustments can be made on the pumping unit from a control panel located remotely at a centralized monitor and control location. The computer-operated controls are described in more detail below.

Figure 2:
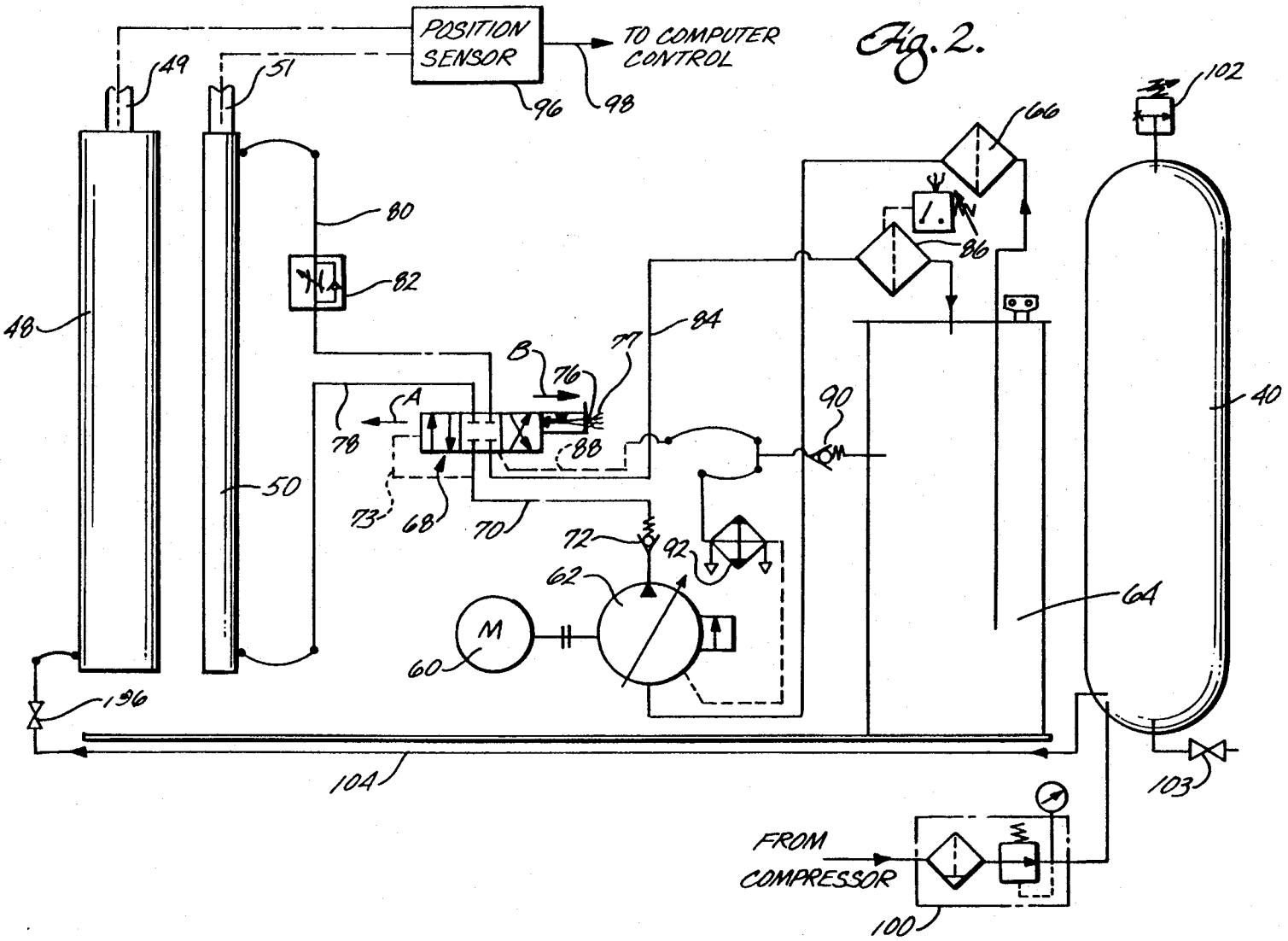
FIG. 2 is a schematic diagram illustrating components of a hydraulic system for operating the pump and a pneumatic balance system.

Operation of the hydraulic and pneumatic system is best understood by referring to the schematic diagram of FIG. 2. The hydraulic system for reciprocating the walking beam includes an electric motor 60 connected to a variable vane hydraulic pump 62. The size of these components is dependent upon the speed and lifting capability of the pumping assembly. Hydraulic fluid is contained in a hydraulic reservoir 64. Pressurized hydraulic fluid is cycled to the hydraulic cylinder 50 to produce the up and down motion of the walking beam. When electrical power is applied to the motor, the hydraulic pump begins to turn, causing hydraulic fluid to flow from the reservoir through the suction filter 66 and into the pump 62. The pump builds up hydraulic pressure and the fluid flows under pressure through an inlet line 70 to the pressure port of an electrical adjustable proportional four-way hydraulic valve 68. This valve is commercially available from Parker Hydraulics. The hydraulic line 70 includes a check valve 72 for preventing backflow of hydraulic fluid to the pump. Hydraulic fluid also flows from the pump through a line 73 to a valve pilot port of the hydraulic valve. When the hydraulic valve is in the closed (centered) position, hydraulic fluid is blocked from flowing and the pump automatically adjusts to compensate for the no-flow condition.

The computer-operated control system produces electrical control signals to the hydraulic valve for controlling valve motion and rate. The control signals are applied to electrical input terminals 76 of the valve from electrical leads 77.

When a DC voltage is applied in a positive direction to electrical input terminals 76 of the valve, the valve moves in the direction indicted by the arrow A. This forces hydraulic fluid through a line 78 to the bottom of the piston in the hydraulic cylinder 50, causing the piston rod 51 to travel upwardly. This pivots the walking beam 26 in the upward direction. During the upward stroke of the hydraulic piston, fluid is forced from the top of the hydraulic cylinder through a line 80 and through a flow control excess fuse 82 to the hydraulic valve 68. The fluid then returns to the hydraulic reservoir through a return line 84 and through a return filter 86.

When a voltage signal is applied in a negative direction to the control terminals 76, the valve moves in the direction indicted by the arrow B. This causes hydraulic fluid to flow under pressure from line 73, through the hydraulic valve and the line to the top of the hydraulic cylinder. This moves the piston rod 51 downwardly to pivot the walking beam in the downward direction. Downward travel of the piston rod forces hydraulic fluid out from the bottom of the cylinder through the line 78 and returns the fluid through the return line 84 and filter 86 to the hydraulic reservoir 64.

The hydraulic line 70 is used to apply hydraulic fluid under pressure to the pilot inlet of the hydraulic valve. This fluid is used to position the valve in response to input voltage signals. The fluid is then returned from the valve through tubing 88 to the hydraulic reservoir. The flow through the tubing 88 is also through a check valve 90 which prevents backflow of hydraulic fluid when the system is not operating.

The case drain of the hydraulic pump 62 is connected to a case drain oil cooler 92 for cooling the hydraulic fluid. This fluid is returned to the hydraulic reservoir through the check valve 90.

The electrical leads 77 from the input terminal 76 of the hydraulic valve are connected to a valve control board (not shown), available from Parker Hydraulics, for controlling the hydraulic valve. This circuit board is used in a system for monitoring the voltage input signals to the valve and valve motion to ensure that the valve provides the correct amount of hydraulic fluid flow.

An arm position sensor 96 senses the traveling motion of the piston rods 49 and 51 of the pneumatic and hydraulic cylinders. The position sensor produces an output signal 98 directly proportional to the travel of each arm for feeding back position information to the process control computer. This information is used to provide a continuous measurement of the instantaneous position of the walking beam throughout its motion cycle. In this way, the computer can detect the upward and downward motion of the walking beam and control the stroke length and stroke rate in accordance with a desired stroke length and rate.

The pneumatic balance system includes a number of components not illustrated in FIG. 2, but which can be readily understood. These include a motor connected to an air compressor that produces air pressure. The pressurized air flows through a check valve into a small high pressure reservoir and turns the motor off when maximum operational pressure is reached. The air pressure from the compressor flows through a pressure regulator 100 which is manually or automatically adjusted to maintain operational air pressure in the large low pressure air reservoir 40. The large low pressure reservoir has a pop-off valve 102 and an air bleed valve for bleeding air pressure to the atmosphere if pressure in the tank exceeds a maximum operational pressure. When the hydraulic cylinder moves the walking beam in the up direction, air flows from the reservoir 40 through a line 104 and through a shut-off valve 106 into the bottom of the air cylinder 48. This air pressure provides lift in addition to the lift produced by the hydraulic cylinder for balancing the static load on the pump.

When the hydraulic cylinder moves the walking beam in the down direction, air returns from the air cylinder 48 through line 104 back into the low pressure air reservoir 40. The air is compressed by the downward motion of the walking beam and by the weight of the downhole rod, pump, and the crude oil. The balance of the system is maintained by air pressure stored in the pneumatic system and does not require energy consumption. Since there are no counterweights, no lateral accelerations or forces are generated.

Figure 3:
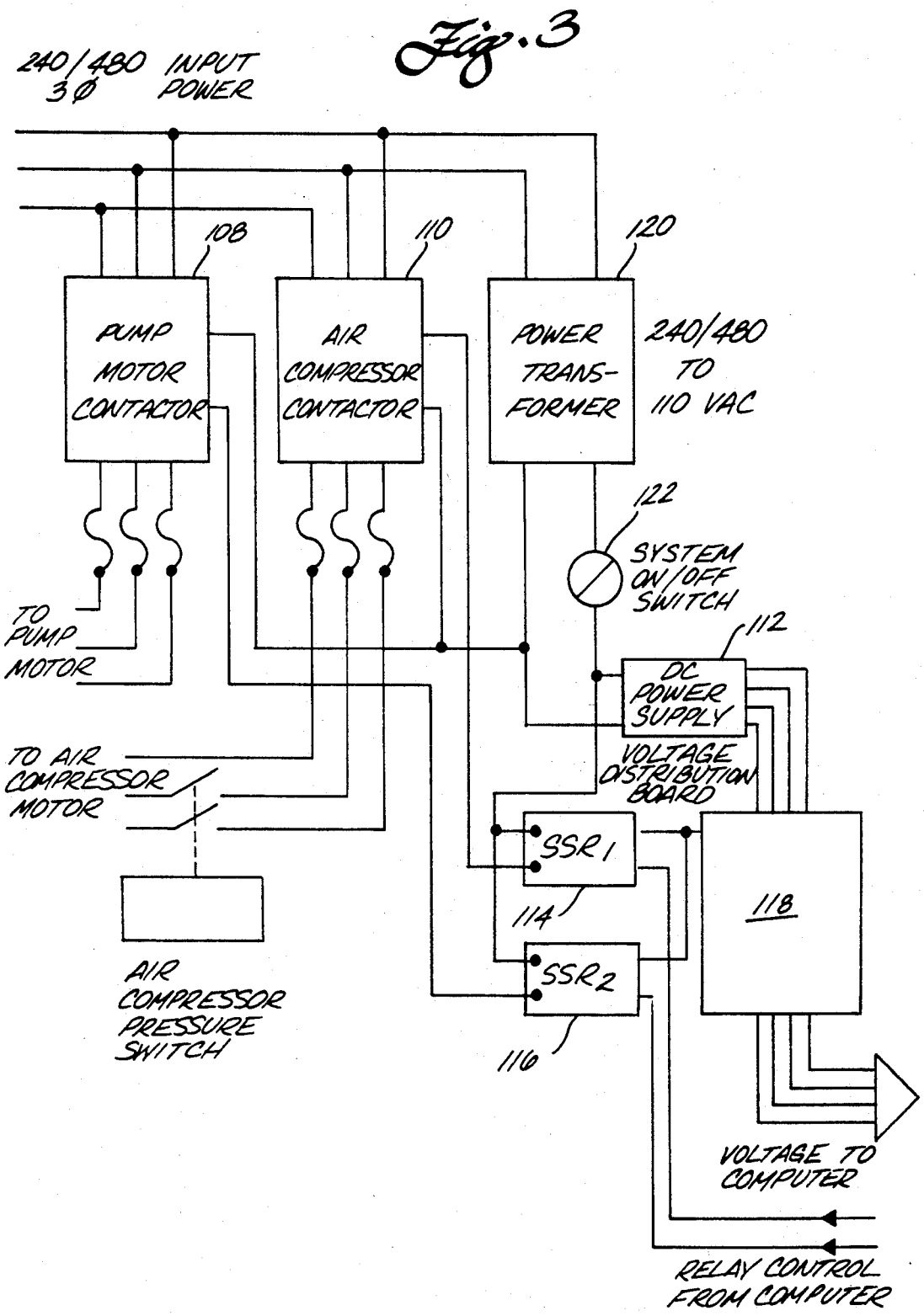
FIG. 3 is an electrical schematic diagram illustrating components of electrical system for operating the hydraulic, pneumatic, and computer-operated controls for the pumping system.

FIG. 3 is a schematic diagram illustrating the electrical power supply system for the hydraulic and pneumatic controls. The power system includes a pump motor control contactor 108, an air compressor contactor 110 and a DC power supply 112. The motor controllers 108 and 110 are wired for 115 volts AC and are controlled by solid state relays 114 and 116 located on a voltage distribution board 118. A power isolation transformer 120 produces 115 volts AC from an input of either 220 or 440 volts AC. The 115 volts AC input is the only voltage turned on or off by the on/off switch 122 on the power supply. Since the motor control contactors require 115 volts AC to operate, opening the switch prevents the air compressor motor or the hydraulic motor from operating. The DC power supply 112 converts the 115 volts AC voltage to the DC voltage, as required by the computer control system and its components. The voltage distribution board 118 is a tie point for all 115 volts AC and DC voltages. Indicator lights (not shown) on the voltage distribution board can assist servicing the well pumping unit.

As alluded to previously, the computer-operated control system 46 controls the reciprocating motion of the walking beam 26 during pumping operations. Briefly, the control system includes a process control computer connected to the hydraulic control valve for controlling the hydraulic piston rod's rate and direction of travel. In addition, the computer receives position feedback signals from the position sensor 96 which indicate the instantaneous position of the walking beam in its range of travel. The computer monitors and controls operation of the hydraulic and pneumatic systems as the pumping unit produces the lift controls necessary to extract crude oil from the well. The computer controls acceleration and deceleration of the walking beam and horsehead assembly, for eliminating any sudden movements or directional changes, which have been problems with prior art mechanically driven hydraulic pumping units. The control system of this invention reduces energy consumption and wear and tear on the pumping equipment.

Figure 4:
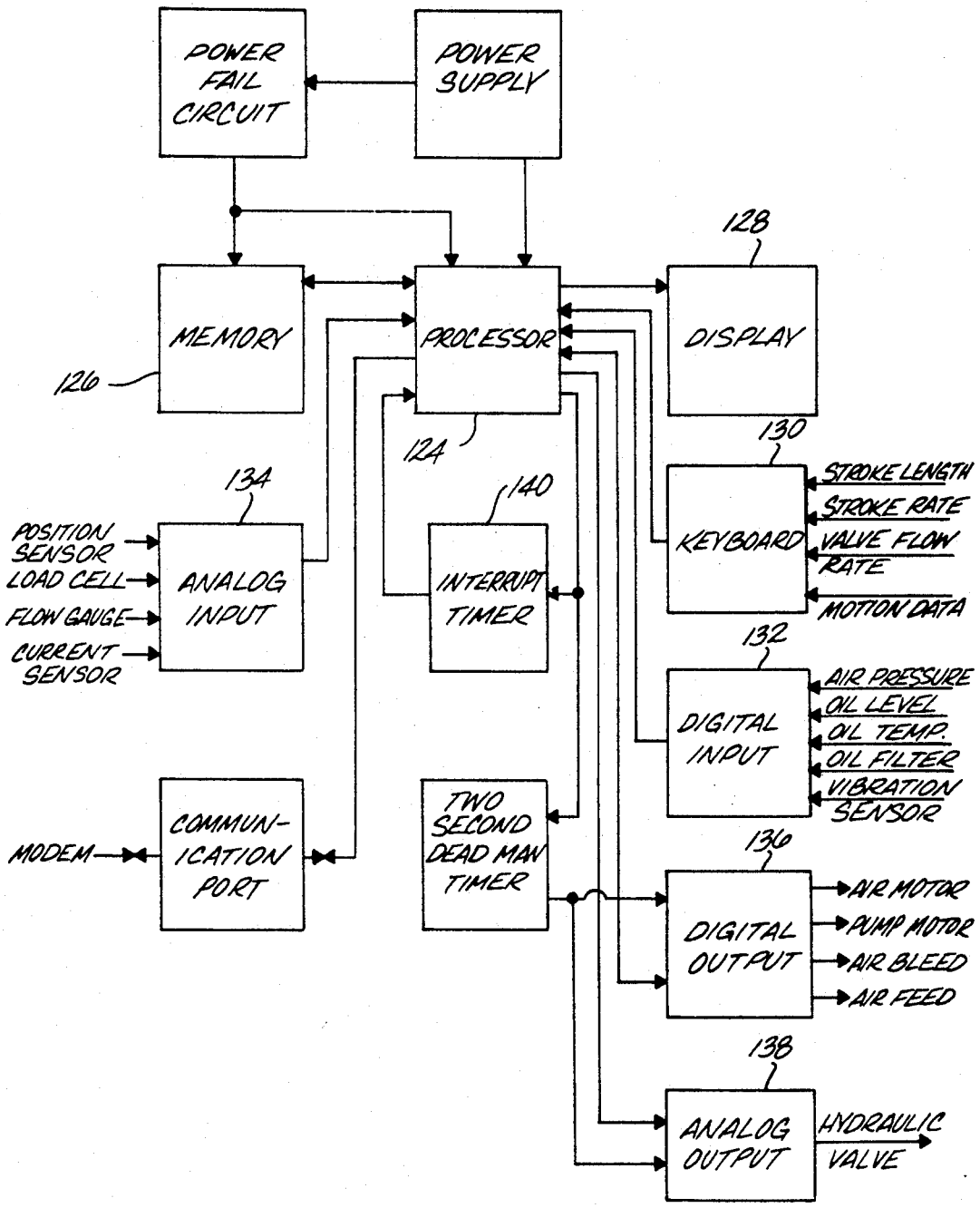
FIG. 4 is a schematic block diagram illustrating components of the computer-operated controls for the pumping system.

FIG. 4 is a schematic block diagram of the computer-operated pump control system, which includes a microprocessor 124 communicating with a computer memory 126. The memory 126 can include program instructions in a read only memory (ROM). The program is preferably in Basic language and was chosen to facilitate implementing the calculations required to control the pump. The computer memory 126 also includes the computer's random access memory (RAM). The microprocessor communicates with a display panel 128 described below. The display panel 128 communicates running conditions and operational values back to the operator. A keyboard 130 communicating with the microprocessor has a panel of switches that permit the operator to change operating conditions of the pump, such as a beam stroke length or stroke rate. Valve flow rate information can be input to the computer to indicate the characteristics of the hydraulic cylinder and pump. Beam motion data are input to provide a desired beam motion-versus-time waveform for the control system. Digital input signals to the microprocessor at 132 include sensed operating data such as air pressure, oil level, oil temperature, oil filter and vibration sensor information. Analog input signals to the microprocessor at 134 include the position feedback signal from the position sensor 96, and signals from a load cell (for measuring mechanical strain on the pump), a flow gauge (for measuring oil flow rate of crude oil from the well), and a current sensor (for indicating electrical power consumption). The load cell is shown at 135 in FIG. 1. Digital output signals from the microprocessor at 136 can include air motor, pump motor, air bleed and air feed information. The principal output signal from the microprocessor is an analog control signal at 138 to the hydraulic control valve for use in cycling the hydraulic piston and walking beam. Output signals from the microprocessor are controlled by an interrupt timer 140 prior to being applied to the valve for controlling travel of the hydraulic piston.

Prior to a more detailed explanation of the computer-operated controls, the general functions of the computer will first be described. The computer is attached to the pumping unit and is connected by a cable to the hydraulic valve, the position sensor is mounted in the hydraulic cylinder, and several other sensors, described below, are connected to the pumping unit. The connection to the hydraulic valve allows the computer to control the rate (or volume) and direction of the hydraulic fluid flow to the hydraulic cylinder. The position sensor provides a voltage output directly proportional to displacement of the hydraulic piston which, in turn, is directly proportional to the instantaneous position of the walking beam.

In addition, the computer is connected to sensors for measuring hydraulic fluid level, hydraulic fluid temperature and the condition of the two hydraulic filters, one on the suction side of the pump and one on the fluid return side of the hydraulic system. The computer also is connected to a pressure switch on the air balance reservoir tank of the pneumatic system. These measurements provide information on the operation of the hydraulic and pneumatic systems for providing early warnings of any conditions that may require temporary shut down of the pump.

Predetermined control input information is entered into the computer by an operator. This information can include stroke length, stroke rate, and dwell times at the top and bottom of the walking beam stroke. The computer processes this information to control the flow rate and volume of hydraulic fluid output from the hydraulic control valve. The computer reads the voltage from the beam position sensor 96 to determine actual beam position and corrects the flow rate and volume of hydraulic fluid from the control valve to maintain the beam position and stroke rate at the desired position and rate.

Operational input data, such as stroke length, stroke rate, or top and bottom dwell time, can be easily changed. The operator simply actuates a function key on the keyboard corresponding to the desired change. The computer displays a current operational value, such as stroke length; and the operator can actuate the data keys corresponding to the desired change. The value is displayed as the data keys are pressed for visual verification. The operator then actuates an "enter" key; and the pump continues operating, using old operational values until it reaches the bottom of the stroke, at which time the computer recalculates the control values based on the new operational information. The computer then starts a new stroke length command based on the new information.

The computer also provides "up-ratio" and "down-ratio" adjustments. These adjustments are described in greater detail below, but at this point it suffices to point out that these functions give the computer the ability to adjust the acceleration and deceleration for the upstroke and for the downstroke of the walking beam. For instance, the pump can be controlled to accelerate rapidly on the downstroke and slowly on the upstroke; or it could decelerate rapidly on the upstroke and slowly on the downstroke; or any other combination of these conditions. In this way, the operator can adjust the desired pump motion to match the particular operational conditions of the well and the downhole equipment.

During normal operation of the pumping unit, the computer continually monitors, through the sensors, the operational conditions of the pump. If any of these conditions require the pump to be stopped, the computer stops the pump and displays the faulty condition on the computer display.

The computer also can be connected to an output from a strain gauge to measure the conditions of the downhole equipment. In this way, the computer can automatically adjust operational input information in accordance with conditions as they change, without the need for an operator to physically enter in new operational values.

Figure 5A:
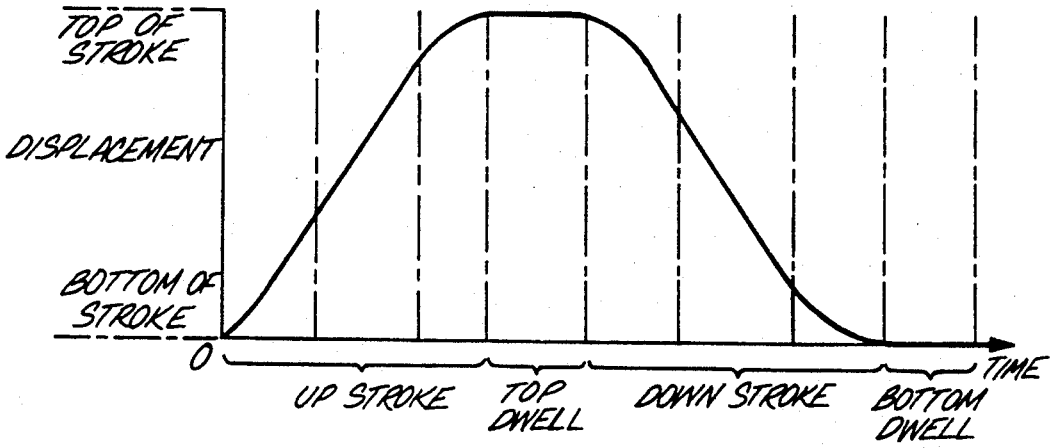
FIGS. 5*a*, 5*b* and 5*c* comprise displacement-versus-time, velocity-versus-time, and acceleration-versus-time waveforms, respectively, representing a desired control for motion of the pumping system.

A principal function of the computer-operated pump motion control system is to control the reciprocating motion of the walking beam throughout well pumping operations. The travel imparted to the walking beam by the hydraulic piston produces a sinusoidal displacement rate (velocity) of the beam with respect to time. Positive displacement occurs on the upstroke and negative displacement occurs on the downstroke of the beam. The program for controlling beam motion automatically controls acceleration and deceleration of the beam to produce the desired stroke length and sinusoidal response in beam motion (velocity) with respect to time. Beam motion is controlled in accordance with a desired velocity-versus-time waveform throughout each cycle of walking beam motion. FIG. 6 illustrates a desired velocity-versus-time waveform programmed into the computer for controlling the desired walking beam motion. FIG. 5*a* illustrates corresponding beam displacement and FIG. 5*c* illustrates the corresponding desired acceleration-versus-time waveform both of which related to the previously described generally sinusoidal response in beam motion (velocity) shown in FIG. 5*b*. The velocity waveform is separated into eight phases or cycles. A first phase 142 is an up-velocity cycle in the form of a ramp input in which beam velocity increases linearly with respect to time up to a maximum velocity. A second phase 144 is constant up-velocity cycle in which the maximum velocity remains constant for a period of time. A third phase 146 is a down cycle in the form of a downramp representing a linear velocity decrease over time from the maximum velocity value down to a zero value. This represents deceleration of the beam to zero during the upstroke of the beam. A fourth phase 148 is an up-dwell section in which velocity remains zero for a predetermined dwell period after the upstroke of the beam. A fifth phase 150 is a down-velocity cycle in the form of a downramp in which velocity increases linearly with respect to time. This velocity is in the downstroke direction of the beam. The down-velocity ramp increases linearly up to a maximum negative acceleration value. A sixth phase 152 is a constant-velocity-constant cycle in which maximum velocity in the negative direction remains constant for a period of time during the downstroke. A seventh phase 154 is a down-velocity cycle in the form of an upramp representing a linear velocity from the maximum negative velocity value to a zero value. A eighth phase 156 is a down-dwell cycle which remains constant at a zero velocity until the end of the pump cycle. The cycle then repeats, starting with the first phase 142.

Figure 5B:
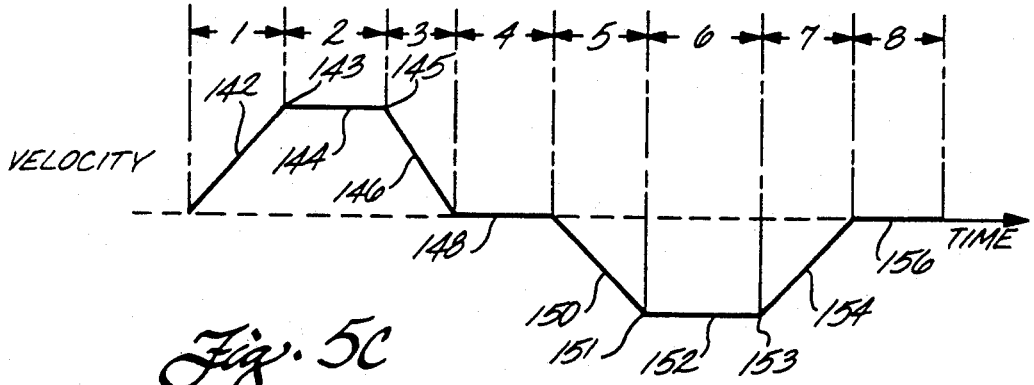
Figure 5C:
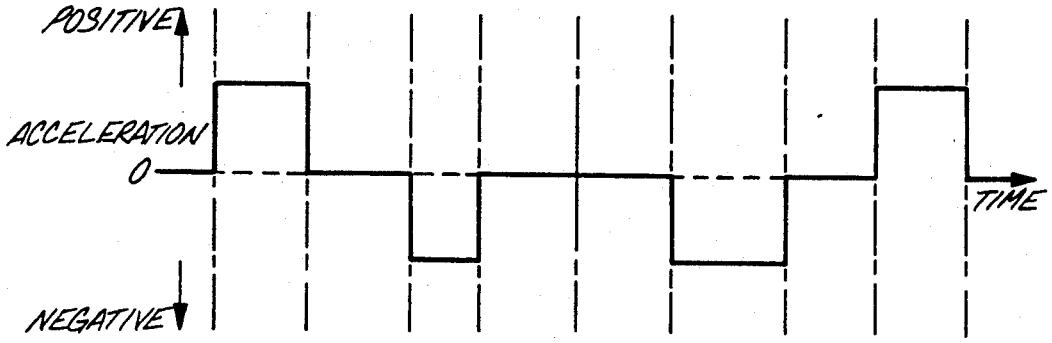
Figure 6:
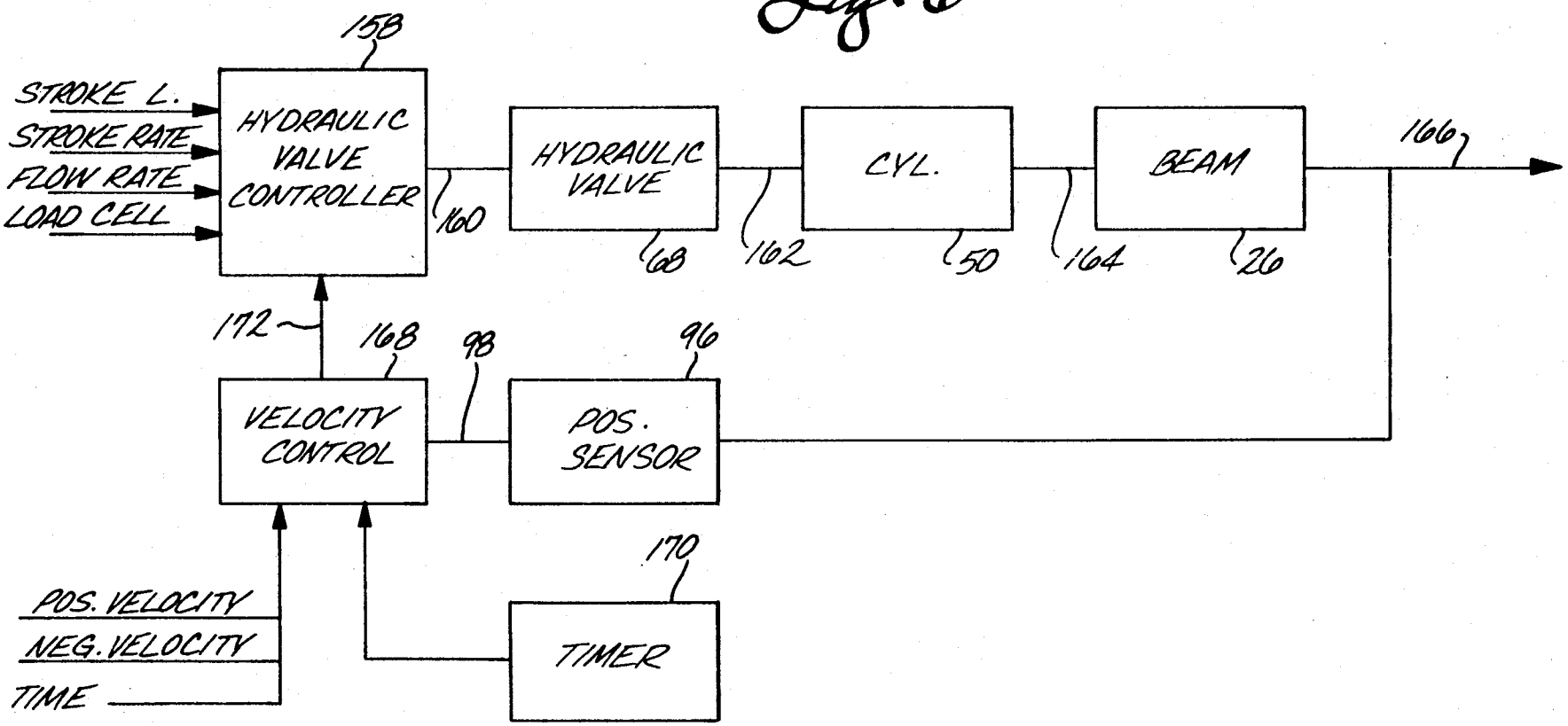
FIG. 6 is a schematic block diagram of the principal components of the control system.
Figure 7A:
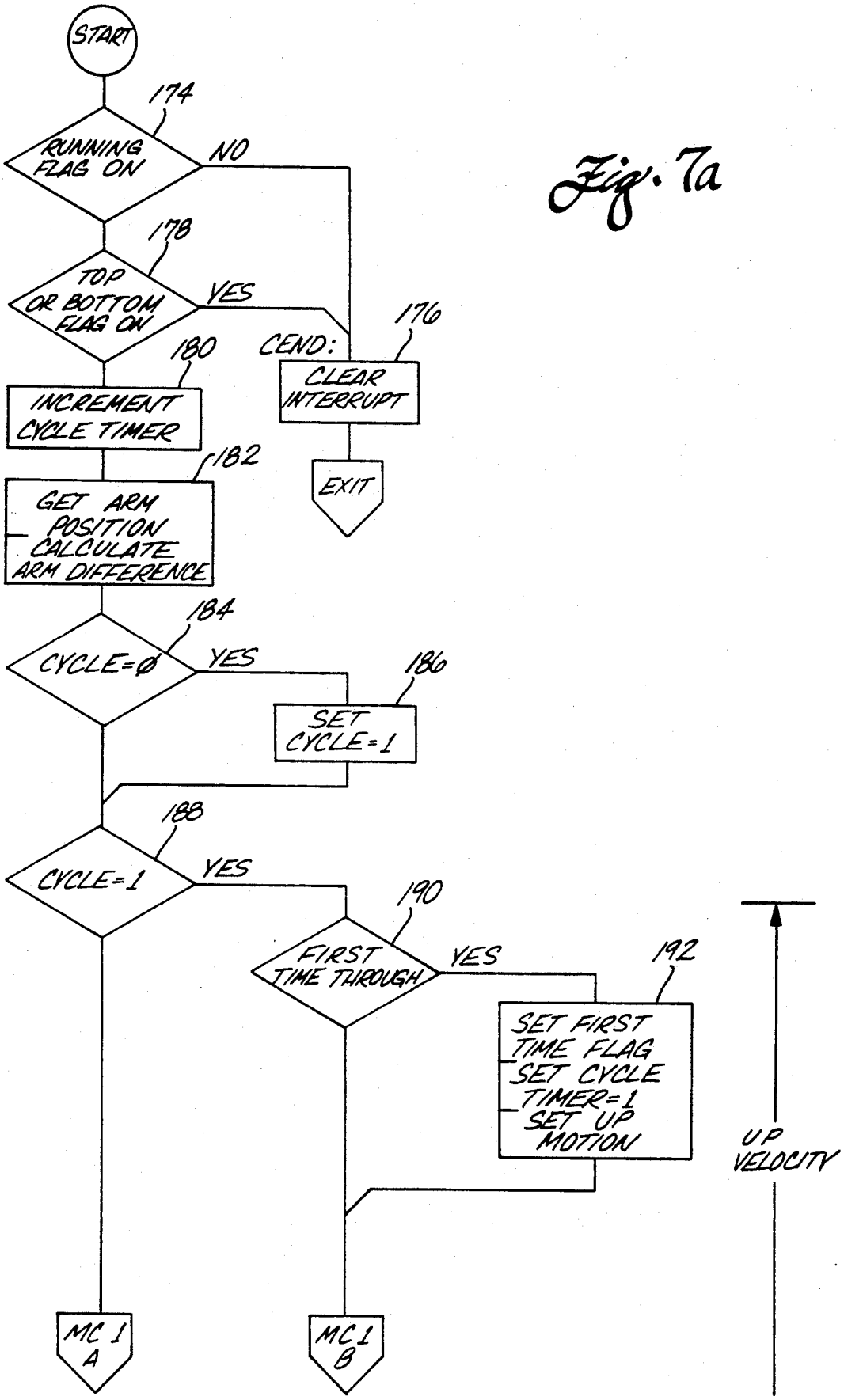
Figure 7B:
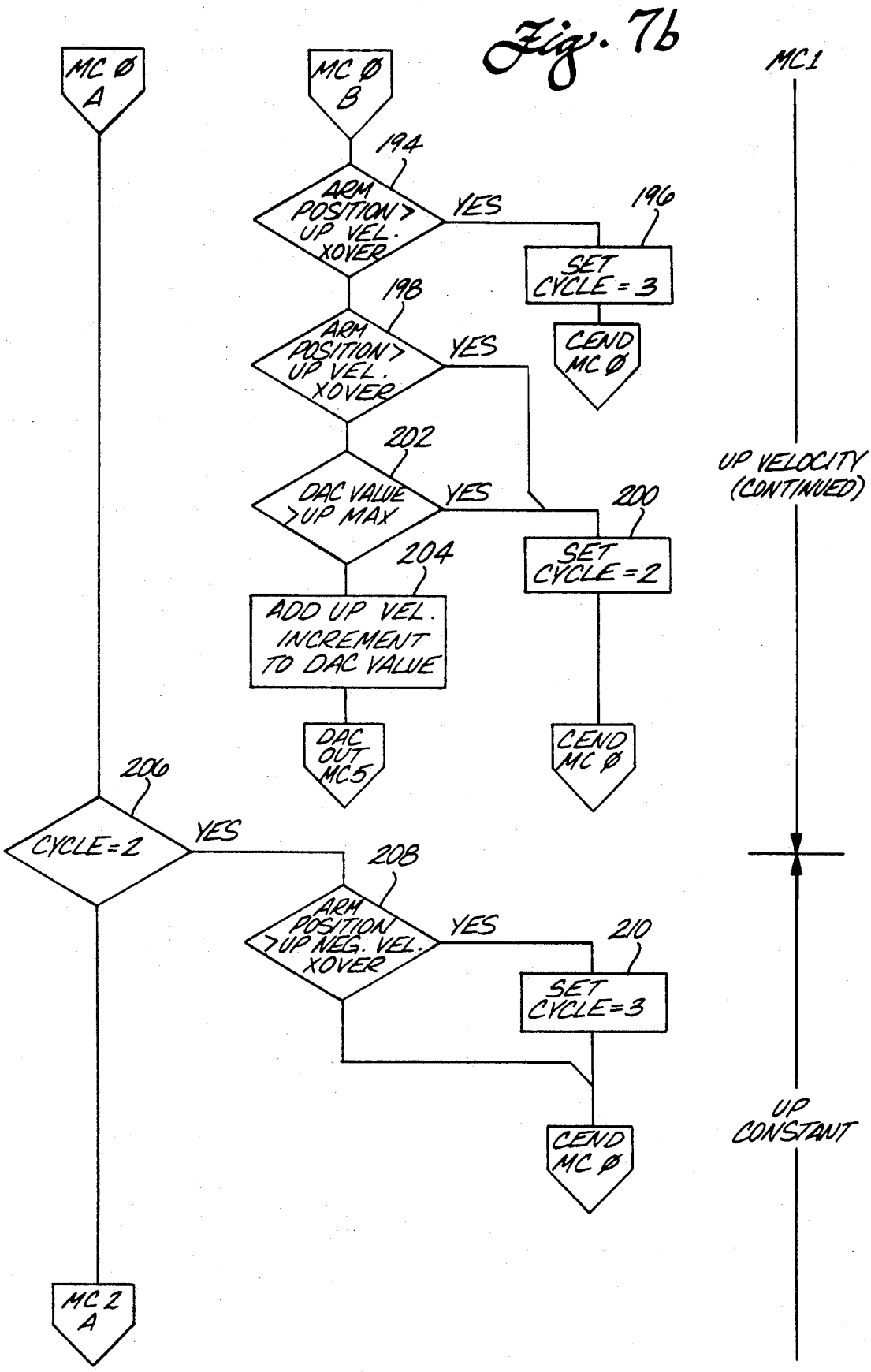
Figure 7C:
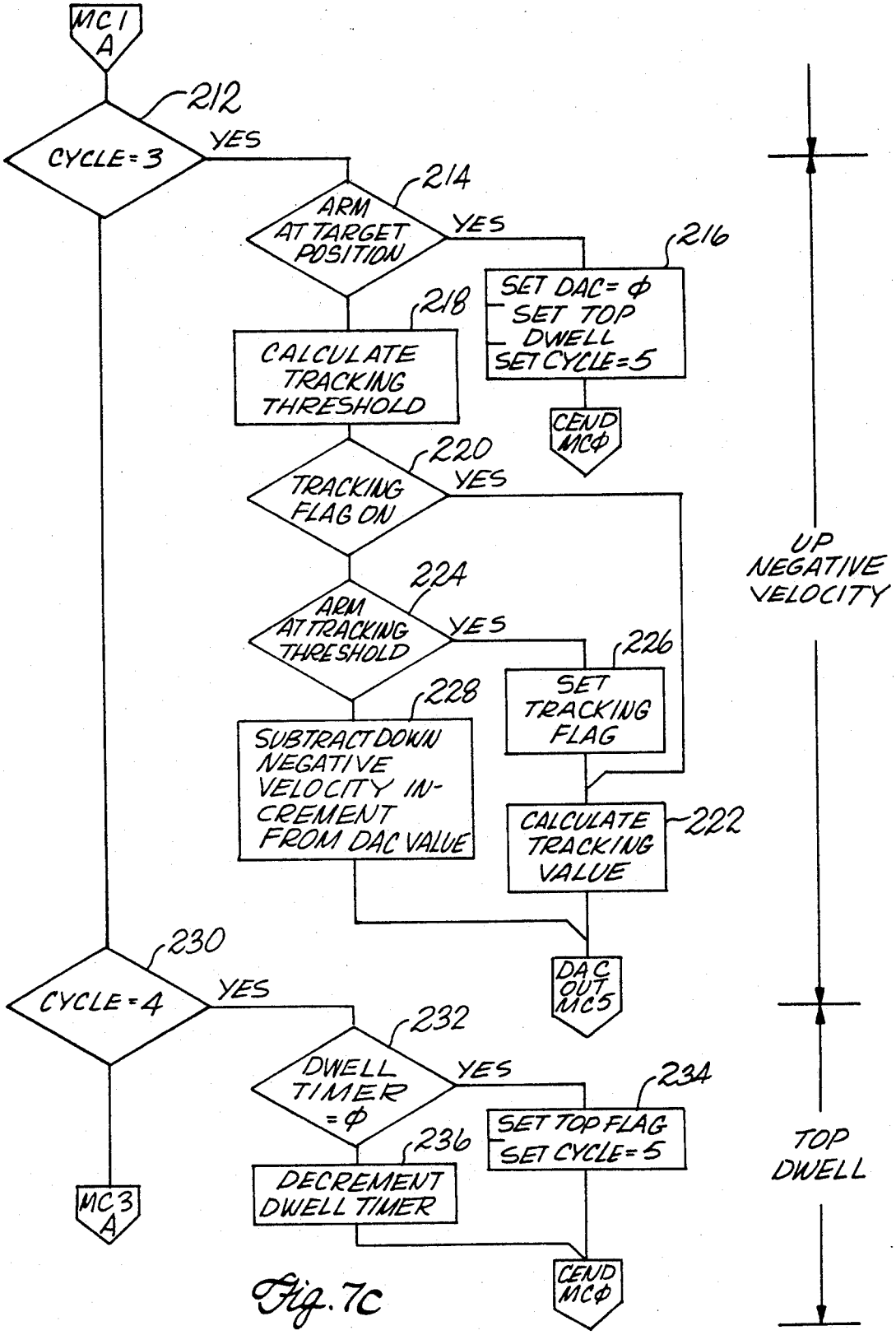
Figure 7D:
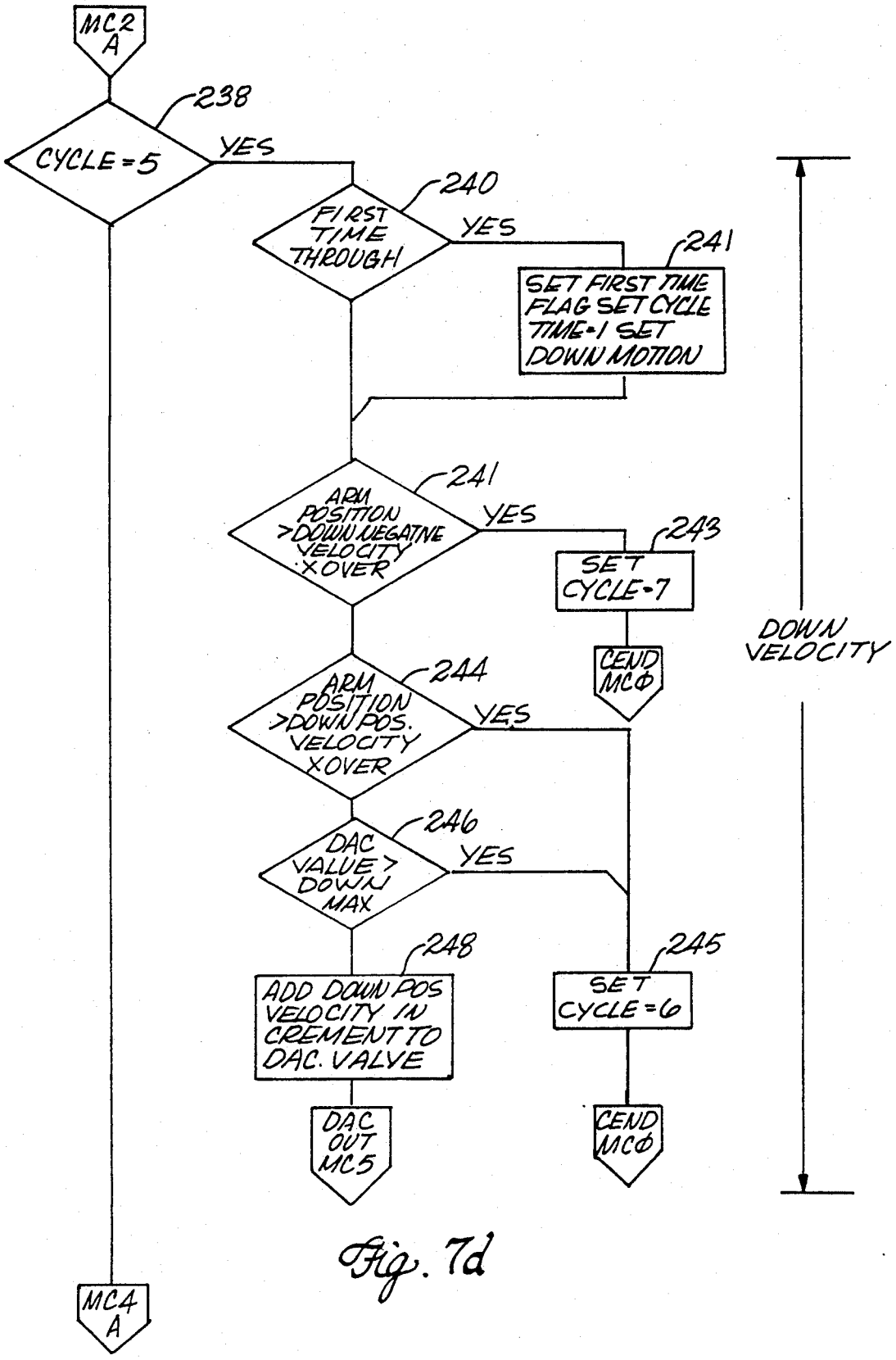
Figure 7F:
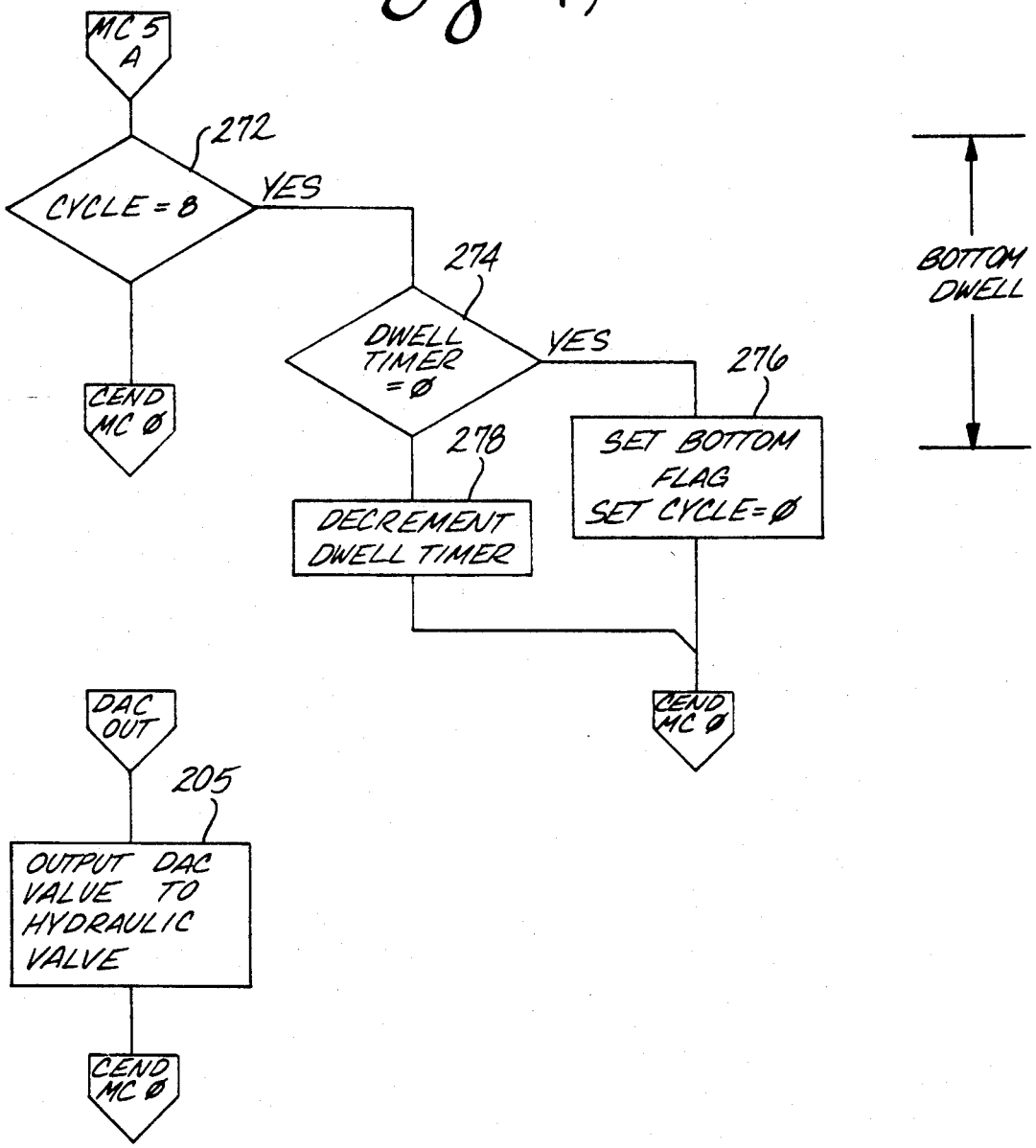

Briefly, pump motion is controlled in accordance with the velocity-versus-time waveform of FIG. 5*b* so that pump speed (stroke rate of the beam) can start slowly in each pump cycle and then speed up after it has picked up speed. The pump is then slowed down as it nears the end of its upstroke. After a short dwell time, the cycle is repeated in the downstroke direction. After another short dwell time, the upstroke cycle is again repeated, and so on.

The description below describes in detail the computer program processing steps for controlling beam velocity-versus-time in accordance with the FIG. 5*b* waveform. In these processing steps, the waveform of FIG. 5*b* defines an up-positive velocity cross-over at 143, an up-negative velocity cross-over at 145, a down-positive velocity cross-over at 151, and a down-negative velocity cross-over at 153.

The velocity waveform in FIG. 5 is only one example of various velocity-versus-time waveforms that can be programmed into the computer for controlling pump motion. For instance, the length of time during any of the eight cycles can be adjusted by making them shorter or longer than shown. Moreover, the length of time for the upstroke of the pump, as controlled by cycles 1 through 4, can have a different total time period than the downstroke of the pump controlled by velocity cycles 5 through 8. For instance, accelerating the pump rapidly on its downstroke may be undesirable, so it may be desirable to accelerate faster on the upstroke and decelerate slower on the downstroke. The actual velocity waveform also can be dependent upon field conditions, such as the type of oil, oil temperature, the relative amounts of oil and water, the distance downhole, and other similar factors.

Control signals from the computer are applied to the hydraulic control valve 68 for cycling the piston rod 51 of the hydraulic cylinder 50. A positive electrical control signal to the hydraulic control valve produces a flow of pressurized hydraulic fluid in a positive direction that produces an upstroke of the piston rod for moving the beam through its upstroke. Similarly, a negative electrical control signal to the hydraulic control valve produces a flow of hydraulic fluid in a negative direction that produces a downstroke of the beam. The magnitude of the electrical control signal to the hydraulic control valve produces a proportional flow rate of hydraulic fluid (gallons per minute) from the control valve to the hydraulic cylinder. The volume flow of fluid to the cylinder is proportional to the resulting speed (stroke rate) of the beam. This relationship is generally linear. Accordingly, the magnitude of the voltage signal to the control valve is directly proportional to the displacement of the beam, and an increase in the voltage signal produces a directly proportional increase in the speed at which the beam travels.

During each upstroke of the beam, the voltage input signal to the valve has increased linearly (up-ramp) with respect to time, up to a maximum voltage, and then has decreased linearly (down-ramp) with respect to time. This produces an up-positive velocity followed by an up-negative velocity of the beam during its upstroke. During each downstroke of the beam, the voltage input signal to the valve has decreased linearly (down-ramp) with respect to time, down to a maximum negative voltage, and then increased linearly (up-ramp) with respect to time up to a zero voltage at the end of the beam cycle. This produces a down-positive velocity followed by a down-negative velocity of the beam during its downstroke.

As emphasized above, the flow rate of fluid from the hydraulic control valve, in gallons per minute, is dependent upon the magnitude of the voltage input signal to the valve. Depending upon the size of the hydraulic cylinder (volume) and the desired displacement rate of the beam in strokes per minute, the magnitude of the voltage signal input to the control valve can be determined in order to produce a desired displacement and stroke rate of the beam from a given hydraulic cylinder. Thus, input signals to the hydraulic control valve can vary in magnitude and rate to produce a given displacement and stroke rate of the beam depending upon the volume and flow rate of the particular hydraulic cylinder.

FIG. 6 is a schematic block diagram illustrating the basic principles of operation of the beam motion control system. A hydraulic valve controller 158 represents a portion of the programmed computer that processes input signals and produces an electrical output signal 160 for controlling operation of the hydraulic control valve 68. The hydraulic valve controller receives the electrical output signals 160 which are proportional to the desired stroke length and stroke rate of the beam. The signals 160 control the flow rate or volume or other capacity information related to the hydraulic cylinder 50. Desired stroke rate of the beam is controlled by an input signal proportional to the desired number of strokes of the beam per minute. The computer program responds to the desired stroke length, stroke rate and hydraulic cylinder volume flow rate input signals to produce the output signal 160 which is proportional to the desired displacement of the beam throughout each beam cycle. The hydraulic control valve produces an output 162 at a fluid flow rate and direction proportional to the instantaneous value of the output signal 160. The flow rate of fluid to the hydraulic cylinder 50 produces a proportional displacement rate of the cylinder piston rod at 164. The displacement of the hydraulic cylinder piston rod produces a corresponding displacement of the walking beam 26, represented at 166. The travel of the walking beam is measured by the position sensor 96 which produces an electrical output signal 98 having a magnitude proportional to the instantaneous position of the beam. The polarity of the position feedback signal 98 represents the beam position during its upstroke or downstroke.

The position feedback signal 98 is received by a velocity controller 168 which is part of the programmed computer for processing information relating to the known position of the walking beam at any time. This position information is compared with the desired position at that time to provide appropriate adjustments in the instantaneous position of the beam, when necessary. The velocity controller also receives input signals relating to the desired velocity-versus-time waveform illustrated in FIG. 5. Input data representing the velocity waveform can include maximum positive velocity maximum negative velocity, and the time-dependent data for each velocity cycle. Such time-related input information can define the cross-over points at 143, 145, 151 and 153, and the dwell times in FIG. 5*b* waveform. The velocity controller also is coupled to a timer 170 together with appropriate circuitry for converting the position feedback signal 98 into a measurement of instantaneous velocity of the beam at any time during its stroke cycle. The velocity controller also includes circuitry for comparing the actual velocity value at any time with the desired velocity value (from the waveform of FIG. 5) at the same time to produce a control signal 172 whenever the compared velocity values indicate that the normal control signal 160 should be adjusted. For instance, if the position sensor indicates that the beam is not moving rapidly enough during a certain portion of the cycle, the velocity controller 168 can produce the signal at 172 for overriding the desired position signal 160 to produce a voltage input to the hydraulic valve that causes the beam to speed up, so that the desired velocity can be achieved. In this instance, the voltage input to the valve would increase more rapidly to produce a proportional increase in volume flow of fluid to the cylinder to move the beam more rapidly.

The processing steps by which the programmed computer controls the motion of the beam are illustrated in the flow diagram of FIG. 7. The computer program uses an 80 millisecond (ms) interrupt timer to produce an interrupt every 40 ms throughout each cycle of beam motion for performing calculations to check whether the beam is correctly following the desired beam position and rate of travel. Assuming that all start-up calculations have been made, and that the system is operating, the interrupt timer produces an interrupt every 40 ms to start the motion calculations (referred to as MC in the flow diagram of FIG. 7). Every 40 ms, whether or not the pump is running, the program accesses a bit memory, also referred to as a flag 174, for determining whether the pump is running. The flags referred to herein are single bits contained in a byte of storage that both the machine code and Basic programs can easily access. The flag bytes, as well as data work areas for the control program, reside in the computer's random access memory. If the flag 174 indicates that the pump is not running, a processing step 176 instructs the program to wait for the next 40 ms interrupt before accessing the running flag 174 again. If the pump is running, a flag 178 is accessed to check whether the walking beam (referred to in the flow diagram as an arm) is at the top or bottom of its stroke. If the arm is not at the top or bottom of its stroke, then the arm is in motion and a processing step 180 increments the cycle timer for counting 40 ms time slots per each acceleration (or velocity) cycle, while a processing step 182 reads the current arm position. The information relating to arm position and cycle time is then used to determine the present arm position at the time the program starts. The computer program starts with a processing step 184 for checking whether the beam is at Cycle-zero position. If the check indicates that the beam is at Cycle-zero, a processing step 186 transfers control to Cycle-1. If the program is not in Cycle-zero at the start-up time, the program is instructed to wait until the next 40 ms time pulse after Cycle-zero and to check to determine whether the program is in Cycle-1 and so forth, cycling ahead to each of the cycles in order, until it is determined which of the eight cycles the program should start with at the start-up time. Once that cycle is determined, the motion control functions are then initiated at that particular stroke position of the arm.

It will be assumed herein that the program has started with Cycle-zero, that the Cycle-1 processing step 188 has been accessed, and that the program is now in Cycle-1, the up-acceleration cycle. In the first 40 ms time interval for Cycle-1, processing step 190 checks whether Cycle-1 in its first 40 ms interval. If so, a processing step 192 sets input data such as the number of time pulses to occur in Cycle-1, the height of each step in Cycle-1, and the maximum height of the ramp for Cycle-1. These input parameters establish the time length of Cycle-1, the steepness of the up-ramp for Cycle-1, (viz., arm speed), and the maximum velocity for Cycle-1, respectively. The input data at 192 are checked during each 40 ms cycle of the program to determine whether any of the input values for the up-velocity ramp of Cycle-1 have been changed since the previous interrupt timer cycle. After the check of input data during the first 40 ms cycle of Cycle-1, a processing step 194 tests whether the present arm position has reached the up-negative velocity cross-over point at 145 in FIG. 5. The programmed computer includes circuitry for converting beam position information (position signal 98) into a measurement of beam velocity. This actual velocity measurement is compared with the desired velocity waveform (from FIG. 5) to determine whether the particular cross-over point has been reached. A preferred technique for testing whether the cross-over point 143 has been reached is to compare measured beam position at a given time interval with the position at which the beam should be at that time, given the desired input stroke length and rate. This comparison determines whether the beam motion has been in accordance with the desired velocity waveform. The processing step 194 ensures that the arm does not accelerate too rapidly during Cycle-1. If the test at 194 indicates that the arm position has reached the up-negative velocity cross-over, a processing step, 196 immediately shifts control to the up-negative velocity step of Cycle-3 in order to immediately control arm acceleration by rapidly decelerating it. If the test at 194 indicates that the arm position has not reached the up-negative velocity cross-over, then a processing step 198 checks whether the arm position has exceeded the up-positive velocity cross-over point 143 on the velocity-versus-time of FIG. 5. If arm position is greater than the up-positive velocity cross-over point, a processing step 200 immediate transfers control to Cycle-2 in order to hold up-positive velocity at a constant value until the up-negative velocity step of Cycle-3 begins.

A processing step 204 tests whether the voltage input signal to the hydraulic control valve has reached its maximum preset value, indicating the end of Cycle-1. A digital-to-analog converter (DAC), not shown, is used to convert digital signals to an analog voltage representing the input voltage signal to the hydraulic control valve for producing arm motion. The analog voltage output of the DAC comprises a ramp from zero to five volts, the minimum and maximum voltage input signals to the hydraulic control valve. The program increments the zero to five volt ramp into 20 millivolt (mv) steps, one step for each of the 40 ms intervals produced by the cycle timer. An increase in the analog voltage from the DAC produces a proportional increase in fluid flow rate from the hydraulic valve which, in turn, increases the velocity at which the arm travels. The arm position sensor 96 produces the analog voltage signal 98 which is fed back to an analog-to-digital converter (ADC), not shown, for converting the analog signal into digital pulses which are fed back to the computer at each S.O.L. time interval. The values output from the position sensor indicate whether the arm has moved far enough to reach the end of Cycle-1 in the velocity waveform. For instance, a large displacement of the beam over a relatively short time interval would indicate rapid velocity. If the test at 202 indicates that the DAC value exceeds the maximum preset value, this indicates that the hydraulic control valve has been opened far enough to move the arm to its maximum desired velocity level for Cycle-1. The program instructions at 200 then end Cycle-1 and start Cycle-2. If the test at 202 indicates that the DAC value has not yet reached the maximum preset value, this indicates that the arm should undergo acceleration. The processor then takes the up-velocity increment height, adds that value to the current DAC value, increasing the voltage to the control valve by a further 20 mv step. This causes the valve to open incrementally further to increase the velocity at which the arm is moved. The cycle time is then incremented, and the processing steps for the next 40 ms interval are repeated, and so on, until the DAC value becomes greater than the maximum preset up-velocity value. A processing step 205, at the bottom of FIG. 7, represents each incremental output of the DAC which is sent to the hydraulic control valve.

A processing step 206 checks to determine whether the arm position is in Cycle-2. If so, the program continues with a Cycle-2 processing step 208 which checks to determine whether arm position is greater than the up-negative velocity start value, i.e., up-negative velocity cross-over at 145 on the FIG. 5 waveform. If so, a processing step 210 sets Cycle-3. If the arm position does not exceed the up-negative velocity start value, the cycle timer is instructed repeatedly to produce a constant up-positive velocity value for the preset duration of Cycle-2 during each continuing S.O.L. interval. When the arm position reaches the up-negative velocity start value, Cycle-3 is initiated.

An initial processing step 212 checks to determine whether the programmed motion for the arm is in Cycle-3. If so, a processing step 214 checks to determine whether the arm is at or has exceeded the target position. That is, the control system is programmed so that the arm reaches its full preset stroke length by the end of Cycle-3. The check at 214 determines whether that preset stroke length or target position has been reached. If it has, a processing step 216 immediately stops further arm motion. The DAC is set to zero to move the value to its center position to stop further flow of hydraulic fluid, the top-dwell value is set, and the program then shifts immediately to Cycle-4. When the DAC is set to zero, for cutting off flow to the hydraulic valve, and when Cycle-4 is set, the cycle time value is saved and a top flag is set to indicate that the top of the arm stroke has been reached. These values are saved for later recalculating the cross-over points at the end of Cycle-5.

If the arm position has not yet reached the target position for Cycle-3, a tracking threshold is calculated at 218 for ensuring smooth slow down during the Cycle-3 velocity reduction step. The tracking threshold is a value calculated to measure how close the arm is to end of the stroke and how fast the arm is moving. The tracking threshold is calculated during each 40 ms interval, and the arm position is compared with the tracking threshold for each interval to determine whether or not the arm can continue to be in slowed down in accordance with the precalculated control scheme. A variety of methods can be used to calculate a tracking threshold value. According to one method, the tracking threshold is a ratio of present arm position to the value of the voltage signal to the DAC. This threshold value can be determined by subtracting current arm position from the arm position target value so that the difference indicates how far the arm is from the end of its stroke. This difference is then divided by two and subtracted from a value representing the voltage signal to the DAC, a value representing how fast the arm is going at any given time. If the tracking threshold is reached during any interval of Cycle-3, the tracking flag 220 removes control of the arm velocity reduction from the precalculated control scheme and calculates a new tracking value at 222. This new tracking value comprises an updated valve control voltage signal that, in effect, increases deceleration of the arm. The updated valve control value is sent to the control valve, the cycle timer is incremented, and Cycle-3 control continues. If the tracking flag at 220 is not on, the program then includes a processing step 224 for checking whether the arm is at the tracking threshold. If the arm has reached the tracking threshold, then program instructions at 226 set a tracking flag, and the processing step at 222 is then followed to remove control from the pre-established control scheme in order to update the valve control value. Further control during Cycle-3 can continue in the tracking mode which has the effect of slowing down the arm more rapidly than the pre-established control mode, so that any high acceleration sensed during the early part of Cycle-3 can be compensated for during the latter part of the cycle by a larger velocity reduction that, in effect, smooths out the decelerating motion of the arm.

The tracking step solves an arm deceleration problem which occurs because such a large mass is being moved during pumping operations. It is desirable that the entire desired stroke length of the pump be attained during each stroke of the pump. The tracking mode ensures that the entire stroke length can be achieved by accurate control over any abnormal deceleration so that large decelerations can be brought under control while still achieving full stroke length. In prior art well pumping systems, the large weight and forces downhole can cause a strain on the mechanical components of the system when rapidly accelerating and decelerating a large mass amounting to several thousand pounds, or more. Any uncontrolled accelerations and decelerations can occur unpredictably and can cause fatigue on the mechanical components of the system, if an uncontrolled system simply is cycled by a fixed sine wave control with no adjustments for conditions downhole.

If the well pumping system is operating within the precalculated control mode for the arm, viz., arm motion is not overridden by the tracking mode, then a processing step 228 allows deceleration to continue by simply tracking the current arm position. In this instance, the down-negative velocity increment is subtracted from the DAC values so as to apply a further incremental negative velocity voltage signal to the control valve, the control value is updated, the cycle timer is incremented, and the program control then shifts to the next S.O.L. interval.

Once the arm reaches its target position for the end of Cycle-3, a processing step at 214 shifts control to the processing step at 216 which then transfers control to the top-dwell mode of Cycle-4.

An initial processing step 230 initially checks to determine whether arm position is in the Cycle-4 mode. If so, a processing step 232 checks to determine whether the dwell time equals the top-dwell time. If so, then a processing st 234 turns a top-dwell flag and then exits to the down-velocity step of Cycle-5.

If the dwell timer step 232 indicates that dwell time has not reached the top-dwell time, the dwell timer is decremented at 236 and the zero voltage input value to the control valve continues for each S.O.L. interval during Cycle-4 until the top-dwell time is finally reached, at which time the program exits to Cycle-5.

A processing step 238 checks to determine whether the arm position is in Cycle-5. If so, a processing step 240 checks to determine whether the program is in the first S.O.L. interval of Cycle-5. During the first interval of Cycle-5, a processing step 241, similar to previous processing step 192, sets a first time flag, sets a cycle timer at a value of one, and initiates down motion. A processing step 242 then checks to determine whether arm position is greater than the down-negative velocity cross-over value. If it is, the program sets Cycle-7 and immediately exists to the down-negative velocity phase of Cycle-7 at 243.

A processing step 244 checks to determine whether arm position is greater than the down-positive velocity cross-over. If so, the program exits to the down-constant-velocity mode of Cycle-6 at 245. A further processing step 246 checks to determine whether the DAC value has reached the maximum set point for down-positive velocity. If it has, the program again exits to Cycle-6. If none of the limits checked in steps 242, 244 and 246 have been reached, the program performs the normal down-positive velocity routine at 248 by updating the valve control value, sending the updated valve control value to the control valve to provide a further increment in down-positive velocity, incrementing the cycle timer, and exiting to the next 40 ms interval of Cycle-5.

A processing step 250 checks to determine whether arm position has reached the Cycle-6 velocity phase. If so, a processing step 252 checks to determine whether arm position has exceeded the down-negative velocity cross-over. If it has, a processing step 254 transfer control to the down-negative velocity phase of Cycle-7. If the arm position has not yet reached the down-negative velocity cross-over, the control signal to the valve remains constant for each time interval, the cycle timer is incremented, and the cycle is repeated until the arm position reaches the down-negative velocity cross-over, at which point control is transferred to Cycle-7.

A processing step 256 checks to determine whether the arm is at the Cycle-7 velocity phase, at which point a processing step 258 checks to determine whether the arm is at the target position for Cycle-7. if the arm has reached the target position, a processing step 260, similar to the processing step 216 of Cycle-3, sets the DAC to zero, sets the bottom-dwell value and transfers control to the bottom-dwell phase of Cycle-8.

Cycle-7 also includes a tracking mode similar to that of Cycle-3 in which a tracking threshold value is calculated at 262 during each S.O.L. interval, as long as the arm has not yet reached its target position. A processing step 264 then checks to determine whether a tracking flag is on. If so, a tracking value is calculated at 266 to produce a control signal to the hydraulic control valve to override normal control and decelerate more rapidly. This smooths out the motion of the arm and ensures achieving full stroke length during the down stroke of the arm. A processing step at 267 checks to determine whether the arm has reached the tracking threshold, and if the tracking threshold has been reached, a tracking flag at 268 is set, a new tracking value is calculated at 266, the valve control value is updated, and program control exits to Cycle-8. A processing step 270 controls down-negative velocity during Cycle-7 for each 40 ms interval, as long as the tracking mode is not implemented so that arm position continues to control the down-negative velocity cycle. During the processing step 270, the valve control value is constantly updated during each 40 ms time interval, the updated valve control value is sent to the control valve, the cycle timer is incremented, and the process is repeated until the arm reaches the target position at processing step 258. At that point, control is transferred to Cycle-8

A processing step 272 checks to determine whether arm position has reached Cycle-8. If so, a processing step 274 checks to determine whether the dwell timer equals zero, indicating completion of the bottom-dwell time. If the dwell timer is at zero, a processing step 276 sets a bottom flag, sets the cycle time to zero, and then exits to transfer control to the main program loop. As long as the dwell timer has not reached zero, a processing step 278 continues to decrement the dwell timer during each 40 ms time interval for producing a zero voltage signal for the bottom-dwell phase of Cycle-8. This continues and the dwell timer continues to be decremented until the cycle timer indicates the end of Cycle-8, at which time program control is returned to the main program loop.

The motion control system illustrated in FIG. 7 also communicates with recalculation routines at the ends of Cycles 4 and 8. If the top-dwell time in Cycle-4 equals a preset top-dwell time, a top flag is turned on, and a separate recalculation routine is initiated. Similarly, whenever the bottom-dwell time in Cycle-8 equals a preset bottom-dwell time, a bottom flag is turned on to initiate a separate recalculation routine FIG. 8 shows a flow diagram illustrating the processing steps of the recalculation routine in which a processing step 280 first checks to determine whether the bottom flag has been turned on and whether a recalculation flag has been turned on. The recalculation routine determines whether the stroke (up or down) just completed was accomplished in the amount of time allocated The purpose is to adjust the maximum valve control voltage during the next S.O.L. cycle, if an error exists. The technique for determining the necessary adjustment is to compare the actual cycle timer values of certain input parameters against their precomputed values and computing a percentage deviation for their parameter. If the recalculation flag and bottom flag are turned on, a processing step 284 performs initial calculations to test for minimum and maximum preset values. These initial conditions include upstroke values such as maximum upstroke length, maximum up-velocity, and the up-cycle cross-over points, and maximum down-values, such as maximum downstroke length, maximum down-velocity and the down-cycle cross-over points. A processing step at 286 checks to determine whether actual up and down values have exceeded the preset values. If the preset initial values have been exceeded, then correct values are calculated by a processing step 288. A processing step 290 then calculates from the current set of up and down values, the current positive velocity, negative velocity and maximum flow to the control value based on current stroke length, stroke rate and velocity waveform calculations.

Once these recalculations have been made, a recalculation flag is reset at 292, and the system then shifts to a processing routine 294 to compare the cycle timer value for the down-positive velocity step against the pre-computed value. As described above, the computer program, for each S.O.L. interval, has an input representing hydraulic cylinder size. The computer program also receives information on the speed of the pump and the stroke length. For each S.O.L. interval, the recalculation routine equates this information to an amount of flow dependent upon the cylinder size and volume of the pump, as well as speed and distance. The computer then permits the pump to correct for up-motion deviation from the precalculated desired motion. For instance, if the previous stroke took too long, the program corrects the up-values for the amount of deviation. At the top-dwell, it recalculates these values so that on the next up-cycle, it can increase up-speed The system is programmed so that it can correct up to a 15% maximum limit in pump speed per stroke. If the bottom flag is on, processing steps 296 and 298 calculate the speed on the previous down-cycle at which the downstroke was completed and compare it with a precalculated desired speed value to obtain a percentage deviation For percentage deviations up to 15%, the initial calculations are corrected in a processing step 300, and this information is then used by the motion control system to speed up arm motion during the next 40 ms interval.

Similarly, if a processing step 301 indicates that a top flag is on, processing steps 302 and 304 determine the speed at which the previous upstroke was achieved and calculate the percentage deviation from the desired speed. The initial calculations are corrected in a processing step 306. This information is then used by the motion control system for increasing the speed of the pump during the next upstroke. If percentage deviations for the up and down stroke speeds are greater than 15%, the maximum value that the control voltage to the hydraulic valve is adjusted up or down is 15%. For either the upstroke or downstroke, the bottom flag and top flag are reset at 308 and 310, and control is then returned to the motion control routine at 312, using the recalculated values.

Thus, the recalculation routine senses whether the control valve is or is not producing a desired time-dependent response of the arm during each cycle. If a deviation from the desired displacement rate is sensed, calculations related to actual displacement and rate are updated, and an error signal is produced to adjust the control signal for the next beam cycle to produce the desired beam displacement and rate.

FIG. 9 schematically illustrates the main processing steps for the computer program. The control registers are initialized at 314 to the configuration desired. All program variables and flags are cleared to zero. In a following processing step 316, the operational defaults are set for stroke length, strokes per minute, top-dwell and bottom-dwell, and stroke ratio, based on the model of pump attached to the processor. The recalculation flag is turned on so that the program calculates the valve control values for operation at the default operational values. In a following processing step 318, the interrupts from the timer are enabled so that the main loop can begin operation normally or to indicate any error condition if one exists.

The motion-adjust routine is then invoked when either a top flag or bottom flag has been set. The function of the motion-adjust system as described above involves a check at 320 to determine whether motion calculations are required. If so, the motion recalculation routine of FIG. 8 calculates the percentage deviation between actual speed and control speed, resets the new motion calculations, and returns the control system to the motion control section of the code.

In a following step 322, the system retrieves information from contact sensors located on the pump for returning information about critical operating conditions. These include air pressure from a sensor installed in the pneumatic system to indicate if air pressure in the system is below operating pressure; a sensor operating by a float in the hydraulic reservoir to indicate a low oil level; a sensor mounted in the hydraulic fluid reservoir for indicating whether the hydraulic fluid has reached an unusually high operating temperature; and sensors mounted in the hydraulic system suction line and fluid return line for indicating excessive back pressure. System control then passes to a processing step 324 for checking whether the entry values on the keyboard have been entered. These values include commands such as start/stop, clear, enter; entry of information from function keys for the input of information such as stroke length, speed and dwell times; and entry of information from data keys.

A following processing step 326 is a display control section for putting informative messages on the display panel of the pump control console. The display can describe the current status of the pump, such as whether it is running, stopped or whether any sensed data should be displayed, such as low oil level, low air pressure, etc.

Function displays at 328 can include information such as stroke length, speed and dwell times.

During the course of operation of the pump, the control system determines the motion which the pump experienced in its previous stroke so that it can change the motion on the next stroke, if necessary. The control system is especially useful in detecting and correcting a pumping-off condition to avoid pounding fluid and resulting wear and tear on the equipment. Load cell output signals from a strain gauge (load cell 135 in FIG. 1) detect whether undue strain is present on the pump rod or walking beam. If the load cell output reaches a predetermined level, the hydraulic valve controller receives a corresponding interrupt signal to shorten the stroke length of the arm to avoid pounding fluid. The pump can be adjusted to the shorter stroke length immediately, and the system will automatically slow down and operate at the shorter stroke length until the pumping-off condition has been corrected. In this way, the computer automatically makes the adjustments to the operational information and adjusts itself to conditions as they change without the need for an operator to physically enter in new operational values or to physically make equipment changes or processing changes at the well site.

What is claimed is:

1. A well pumping system comprising:

a pivotally supported beam connected to a pump rod extending to a downhole pump in which the pump rod reciprocates when the beam pivots cyclically;

a drive piston and cylinder connected to the beam for displacing the beam cyclically over a stoke length in response to reciprocating motion of the drive piston;

piston drive means responsive to an input control signal for reciprocating the drive piston to control corresponding cyclical motion of the beam over the beam stroke length; and closed loop control means for producing the input control signal to the piston drive means as a function of time through out each cycle of beam displacement to control beam motion during the cycle, the closed loop control means including (a) means for sensing the actual positive of the beam throughout each cycle of beam displacement and producing a position signal representing the displacement of the beam during each cycle of beam motion; (b) means responsive to the position signal for producing a velocity signal representing the actual velocity of the beam during each cycle of beam motion; (c) means for producing a velocity control signal representative of a predetermined desired velocity-versus-time waveform representing desired velocity of the beam during each cycle of beam motion; and (d) means for adjusting the input control signal to the piston drive means in accordance with a measured deviation between the velocity signal and the velocity control signal throughout the cycle of beam motion for causing the beam displacement to follow the desired velocity-versus-time waveform throughout each cycle of beam motion.

2. The system according to claim 1 in which the velocity and waveform associated with each displacement cycle of the beam includes up-positive velocity, up-negative velocity, down-positive velocity, and down-negative velocity phases, in that order.

3. The system according to claim 1 in which the velocity and waveform associated with each displacement cycle of the beam includes up-positive velocity, up-constant, up-negative velocity, up-dwell, down-positive velocity, down-constant, down-negative velocity, and down-dwell phases, in that order.

4. The system according to claim 1 in which the closed loop control means includes means for sensing over-acceleration during a cycle of the beam displacement, and means for correcting the over-acceleration mid-cycle in the beam displacement.

5. The system according to claim 1 including load cell means for sensing mechanical strain in the beam, and in which the closed loop control means are also responsive to an output signal from the load cell means to adjust the stroke length of the beam when mechanical strain above a preset level is sensed.

6. A system according to claim 1 including means for producing a first input signal representing an adjustable beam stroke length and a second input signal representing an adjustable beam stroke; and in which the closed loop control means are also responsive to the first and second input signals for adjusting the predetermined velocity-versus-time waveform.

7. The system according to claim 6 including means for producing a third input signal representing one or more time values during a cycle of beam displacement, and in which the closed loop control means are also responsive to at least one of the third input signals for adjusting the time periods during which changes in velocity occur during the desired velocity-versus-time waveform.

8. The system according to claim 7 in which the drive piston is a hydraulic cylinder and piston, and the piston drive means is a hydraulic control value; and in which the input control signal is an adjustable voltage signal to the control valve for producing hydraulic fluid flow to the hydraulic cylinder in proportion to the required displacement of the beam over time.

9. The system according to claim 8 including means for producing a fourth input signal representing the volume flow capacity of the hydraulic fluid from the control valve to the hydraulic piston; and in which the closed loop control means is responsive to the fourth control signal for adjusting the voltage signal to the control valve to produce a corresponding adjustment of beam displacement in proportion to the volume flow characteristic of the hydraulic cylinder.

10. A well pumping system comprising:

a pivotally supported beam connected to a pump rod extending to a downhole pump in which the pump rod reciprocates when the beam pivots cyclically;

a drive piston and cylinder connected to the beam for displacing the beam cyclically over a stroke length in response to reciprocating motion of the drive piston;

piston drive means responsive to an input control signal for reciprocating the drive piston to control corresponding cyclical motion of the beam over an adjustable beam stroke length at an adjustable beam stroke rate;

closed loop control means for producing the input control signal to the piston drive means as a function of time throughout each cycle of beam displacement to control beam motion during the cycle, the closed loop control means including (a) means for sensing the actual position of the beam throughout each cycle of beam displacement and producing a position signal representing the displacement of the beam during each cycle of beam motion; (b) means responsive to the position signal for producing a velocity signal representing the actual velocity of the beam during each cycle of beam motion; (c) means for producing a velocity control signal representative of a predetermined desired velocity-versus-time waveform representing desired velocity of the beam during each cycle of beam motion; and (d) means for adjusting the input control signal to the piston drive in accordance with a measured deviation between the velocity signal and the velocity control signal throughout the cycle of beam motion for causing the beam displacement to follow the desired velocity-versus-time waveform throughout each cycle of beam motion, means for producing a first input signal representing an adjustable beam stroke length; and means for producing a second input signal representing an adjustable beam stroke rate;

in which the closed loop control means are responsive to the first and second input signals for adjusting the predetermined desired velocity-versus-time waveform.

11. A system according to claims 10 including means for producing a third input signal representing one or more time values during a cycle of beam displacement, and in which the control means are also responsive to at least one of the third input signals for adjusting the time periods during which velocity changes occur during the desired velocity-versus-time waveform.

12. The system according to claim 10 in which the desired velocity and waveform associated with each displacement cycle of the beam includes up-positive velocity, up-negative velocity, down-positive velocity and down-negative velocity phases, in that order.

13. The system according to claim 10 in which the desired velocity and waveform associated with each displacement cycle of the beam includes up-positive velocity, up-constant, up-negative velocity, up-dwell, down-positive velocity, down-constant, down-negative velocity, and down-dwell phases, in that order.

14. The system according to claim 10 in which the control means includes means for sensing over-acceleration during a cycle of the beam displacement and means for correcting the over-acceleration mid-cycle in the beam displacement.

15. The system according to claim 10 including load cell means for sensing mechanical strain in the beam, and in which the control means are also responsive to an output signal from the load cell means to adjust the stroke length of the beam when mechanical strain above a preset level is sensed.

16. The system according to claim 11 in which the drive piston is a hydraulic cylinder and piston, and the piston drive is a hydraulic control valve, and in which the input control signal is an adjustable voltage signal to the control valve for producing hydraulic fluid flow to the hydraulic cylinder in proportion to required displacement of the beam as a function of time.

17. The system according to claim 16 including means for producing a fourth input signal representing the volume flow capacity of hydraulic fluid from the control valve to the hydraulic piston, and the control means is responsive to the fourth control signal for adjusting the voltage signal to the control valve to produce a corresponding adjustment of beam displacement in proportion to the volume flow characteristic of the hydraulic cylinder.

18. A well pumping system comprising:

a pivotally supported beam connected to a pump rod extending to a downhole pump in which the pump rod reciprocates when the beam pivots cyclically;

a drive piston and cylinder connected to the beam for displacing the beam cyclically over a stroke length in response to reciprocating motion of the drive piston;

piston drive means responsive to an input control signal for reciprocating the drive piston to control corresponding cyclical motion o the beam over the beam stroke length;

means for sensing the actual position of the beam and producing a position signal representing the cyclical displacement of the beam during its operation of the pump rod;

data input means for entering information to a microprocessor representing a predetermined desired velocity-versus-time waveform representing the desired velocity of the beam during each cycle of beam motion; and closed loop control means responsive to the velocity control signal input to the data processor means and responsive to the position signal throughout the displacement cycle of the beam for controlling the input control signal to the drive piston for causing beam displacement to follow the desired velocity-versus-time waveform over the stroke length of the beam.

19. The system according to claim 18 including load cell means for sensing mechanical strain in the beam and on the pump, and in which the control means are also responsive to an output signal from the load cell means to adjust the stroke length of the beam when the load cell senses mechanical strain above a preset level.

20. The system according to claim 19 in which the output signal from the load cell adjusts the stroke rate of the beam and adjusts a time and amplitude-dependent profile of the velocity-versus-time waveform.

21. A well pumping system for controlling displacement of the pivotally supported beam connected to a pump rod extending to a downhole pump in which the pump rod reciprocates when the beam pivots cyclically, the system comprising:

a drive piston and cylinder to connected to the beam for displacing the beam cyclically over a stroke length in response to reciprocating motion of the drive piston;

piston drive means responsive to an input control signal for displacing the drive piston over the stroke length at an adjustable stroke rate for controlling the cyclical motion of the beam;

means for sensing the actual position of the beam and producing a position signal representing the cyclical displacement of the beam during its operation of the pump rod;

closed loop control means responsive to the position signal and having a control input representing a predetermined displacement of the beam at a predetermined displacement rate during each stroke length of the beam for adjusting the input control signal to the piston drive means in accordance with a measured deviation between the sensed actual position of the beam and the predetermined position of the beam during the stroke length of the beam for causing beam displacement to follow the desired displacement and displacement rate over the stroke length of the beam; and load cell means for sensing mechanical strain in the beam and on the pump, and in which the closed loop control means are responsive to an output signal from the load cell means to adjust the stroke length of the beam when the load cell senses mechanical strain above a preset level.

22. The system according to claim 21 in which the output signals from the load cell adjusts the stroke rate of the beam and adjusts a time and amplitude-dependent profile of the velocity-versus-time waveform.

23. A well pumping system for controlling displacement of a pivotally supported beam connected to a pump rod extending to a downhole pump in which the pump rod reciprocates when the beam pivots cyclically, the system comprising:

a drive piston and cylinder connected to the beam for displacing the beam cyclically over a stroke length in response to reciprocating motion of the drive piston;

piston drive means responsive to an input control signal for displacing the drive piston over the stroke length at an adjustable stroke rate for controlling the cyclical motion of the beam;

means for sensing the actual position of the beam and producing a position signal representing the cyclical displacement of the beam during its operation of the pump rod;

data input means for entering information to a microprocessor representing a desired displacement rate of the beam with respect to time over a desired stroke length throughout each displacement cycle of the beam; and closed loop control means responsive to the input information and responsive to the position signal throughout the displacement cycle of the beam for controlling the input control signal to the drive piston for causing beam displacement to follow the desired beam displacement rate over the stroke length of the beam;

the data input means including information representing the desired stroke length of the beam, the desired stroke rate of the beam, and drive piston and cylinder flow volume and flow rate for controlling the input control signal to the piston drive means.

* * * * *